US011794065B2

(12) United States Patent
Lagree et al.

(10) Patent No.: US 11,794,065 B2
(45) **Date of Patent: *Oct. 24, 2023**

(54) EXERCISE MACHINE WITH ADJUSTABLE PLATFORMS

(71) Applicant: Lagree Technologies, Inc., Chatsworth, CA (US)

(72) Inventors: Sebastien Anthony Louis Lagree, Chatsworth, CA (US); Max E. Wunderlich, Los Angeles, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/954,032

(22) Filed: Sep. 27, 2022

(65) Prior Publication Data

US 2023/0027177 A1 Jan. 26, 2023

Related U.S. Application Data

(63) Continuation of application No. 17/380,196, filed on Jul. 20, 2021, now Pat. No. 11,465,011.

(51) Int. Cl.

| | |
|---|---|
| ***A63B 21/00*** | (2006.01) |
| ***A63B 22/20*** | (2006.01) |
| ***A63B 21/068*** | (2006.01) |
| ***A63B 22/00*** | (2006.01) |

(52) U.S. Cl.

CPC ..... *A63B 21/4045* (2015.10); *A63B 21/068* (2013.01); *A63B 21/4035* (2015.10); *A63B 22/0023* (2013.01); *A63B 22/0089* (2013.01); *A63B 22/203* (2013.01); *A63B 2208/0219* (2013.01); *A63B 2225/09* (2013.01)

(58) Field of Classification Search

CPC ..... A63B 21/4045; A63B 21/068; A63B 21/4035; A63B 22/0023; A63B 22/0089; A63B 22/203; A63B 2208/0219; A63B 2225/09

See application file for complete search history.

(56) References Cited

U.S. PATENT DOCUMENTS

| | | | |
|---|---|---|---|
| 1,621,477 | A | 3/1927 | Pilates |
| 3,770,267 | A | 11/1973 | McCarthy |
| 4,759,540 | A | 7/1988 | Yu |
| 4,798,378 | A | 1/1989 | Jones |

(Continued)

FOREIGN PATENT DOCUMENTS

WO 2004096376 A1 11/2004

*Primary Examiner* — Andrew S Lo

(74) *Attorney, Agent, or Firm* — Neustel Law Offices

(57) ABSTRACT

An exercise machine with adjustable platforms for adjusting the angular orientation of one or more end platforms and/or carriage platform to allow for a wide range of exercise moves. The exercise machine includes a rail to which a carriage is movably connected and a first end platform connected to an end of the rail. The carriage includes a platform which may be adjusted between a level position in which the platform is laid flat and a raised position in which the platform is at an angular incline. The first end platform may similarly and independently be adjustable between the level position in which the first end platform is laid flat and a raised position in which the first end platform is at an angular incline. In some embodiments, the exercise machine may include a second end platform which is similarly adjustable between a level position and a raised position.

20 Claims, 15 Drawing Sheets

(56) References Cited

U.S. PATENT DOCUMENTS

| | | | |
|---|---|---|---|
| 5,066,005 | A | 11/1991 | Luecke |
| 5,263,913 | A | 11/1993 | Boren |
| D362,700 | S | 9/1995 | Breibart |
| D382,319 | S | 8/1997 | Gerschefske |
| 5,681,249 | A | 10/1997 | Endelman |
| 5,885,197 | A | 3/1999 | Barton |
| 5,967,955 | A | 10/1999 | Westfall |
| 6,179,753 | B1 | 1/2001 | Barker |
| 7,163,500 | B2 | 1/2007 | Endelman |
| 7,803,095 | B1 | 9/2010 | Lagree |
| 7,931,570 | B2 | 4/2011 | Hoffman |
| 8,249,714 | B1 | 8/2012 | Hartman |
| 8,585,554 | B2 | 11/2013 | Shavit |
| 8,641,585 | B2 | 2/2014 | Lagree |
| 9,072,931 | B2 | 7/2015 | Lagree |
| 9,119,989 | B1 | 9/2015 | Lagree |
| 9,138,606 | B2 | 9/2015 | Lagree |
| 9,211,440 | B2 | 12/2015 | Lagree |
| 9,283,422 | B2 | 3/2016 | Lagree |
| 9,370,679 | B2 | 6/2016 | Lagree |
| 9,393,454 | B2 | 7/2016 | Lagree |
| D764,606 | S | 8/2016 | Lagree |
| 9,415,253 | B2 | 8/2016 | Lagree |
| 9,457,216 | B2 | 10/2016 | Lagree |
| 9,457,225 | B2 | 10/2016 | Lagree |
| 9,474,924 | B2 | 10/2016 | Lagree |
| 9,474,926 | B1 | 10/2016 | Lagree |
| 9,474,927 | B2 | 10/2016 | Lagree |
| D772,992 | S | 11/2016 | Lagree |
| 9,498,667 | B1 | 11/2016 | Lagree |
| 9,517,375 | B2 | 12/2016 | Lagree |
| 9,522,299 | B2 | 12/2016 | Lagree |
| 9,533,184 | B1 | 1/2017 | Lagree |
| 9,533,185 | B1 | 1/2017 | Lagree |
| 9,545,535 | B2 | 1/2017 | Lagree |
| 9,555,282 | B1 | 1/2017 | Lagree |
| 9,579,536 | B1 | 2/2017 | Lagree |
| 9,579,555 | B2 | 2/2017 | Lagree |
| 9,586,081 | B2 | 3/2017 | Lagree |
| 9,586,089 | B2 | 3/2017 | Lagree |
| 9,597,545 | B1 | 3/2017 | Lagree |
| 9,604,095 | B1 | 3/2017 | Lagree |
| 9,604,097 | B1 | 3/2017 | Lagree |
| D785,104 | S | 4/2017 | Lagree |
| 9,643,051 | B1 | 5/2017 | Lagree |
| 9,649,526 | B2 | 5/2017 | Lagree |
| 9,649,527 | B1 | 5/2017 | Lagree |
| D789,463 | S | 6/2017 | Lagree |
| 9,700,754 | B2 | 7/2017 | Lagree |
| 9,717,945 | B2 | 8/2017 | Lagree |
| 9,744,395 | B1 | 8/2017 | Lagree |
| 9,776,043 | B2 | 10/2017 | Lagree |
| 9,776,062 | B2 | 10/2017 | Lagree |
| 9,789,354 | B2 | 10/2017 | Lagree |
| 9,808,664 | B2 | 11/2017 | Lagree |
| 9,849,330 | B2 | 12/2017 | Lagree |
| 9,868,009 | B2 | 1/2018 | Lagree |
| 9,868,010 | B2 | 1/2018 | Lagree |
| 9,868,011 | B2 | 1/2018 | Lagree |
| 9,868,018 | B2 | 1/2018 | Lagree |
| 9,868,019 | B2 | 1/2018 | Lagree |
| 9,914,014 | B2 | 3/2018 | Lagree |
| 9,962,573 | B2 | 5/2018 | Lagree |
| 9,962,592 | B2 | 5/2018 | Lagree |
| 9,981,156 | B2 | 5/2018 | Lagree |
| 10,016,655 | B2 | 7/2018 | Lagree |
| 10,022,577 | B2 | 7/2018 | Lagree |
| 10,022,581 | B2 | 7/2018 | Lagree |
| 10,029,141 | B2 | 7/2018 | Lagree |
| 10,046,193 | B1 | 8/2018 | Aronson |
| 10,052,518 | B2 | 8/2018 | Lagree |
| 10,065,069 | B1 | 9/2018 | Lagree |
| 10,109,216 | B2 | 10/2018 | Lagree |
| 10,118,067 | B2 | 11/2018 | Lagree |
| 10,124,232 | B2 | 11/2018 | Lagree |
| 10,143,882 | B2 | 12/2018 | Lagree |
| 10,150,003 | B2 | 12/2018 | Lagree |
| 10,155,129 | B2 | 12/2018 | Lagree |
| 10,201,724 | B2 | 2/2019 | Lagree |
| 10,213,641 | B2 | 2/2019 | Lagree |
| 10,220,244 | B2 | 3/2019 | Lagree |
| 10,238,910 | B2 | 3/2019 | Lagree |
| 10,265,573 | B2 | 4/2019 | Lagree |
| 10,272,285 | B2 | 4/2019 | Lagree |
| 10,279,207 | B2 | 5/2019 | Lagree |
| 10,300,328 | B2 | 5/2019 | Lagree |
| 10,369,398 | B2 | 8/2019 | Lagree |
| 10,478,656 | B2 | 11/2019 | Lagree |
| 10,478,663 | B2 | 11/2019 | Lagree |
| 10,486,017 | B1 | 11/2019 | Lagree |
| 10,493,321 | B2 | 12/2019 | Lagree |
| 10,500,441 | B2 | 12/2019 | Lagree |
| 10,518,127 | B2 | 12/2019 | Lagree |
| 10,549,140 | B2 | 2/2020 | Lagree |
| 10,561,896 | B2 | 2/2020 | Lagree |
| 10,569,118 | B2 | 2/2020 | Lagree |
| 10,603,546 | B1 | 3/2020 | Lagree |
| 10,695,645 | B1 | 6/2020 | Lagree |
| 10,702,730 | B2 | 7/2020 | Lagree |
| 10,702,760 | B2 | 7/2020 | Lagree |
| 10,716,964 | B1 | 7/2020 | Lagree |
| 10,744,370 | B1 | 8/2020 | Lagree |
| 10,751,600 | B2 | 8/2020 | Lagree |
| 10,780,307 | B2 | 9/2020 | Lagree |
| 10,792,528 | B1 | 10/2020 | Lagree |
| 10,792,538 | B2 | 10/2020 | Lagree |
| 10,835,775 | B1 | 11/2020 | Lagree |
| 10,850,155 | B2 | 12/2020 | Lagree |
| 10,850,158 | B2 | 12/2020 | Lagree |
| 10,857,418 | B2 | 12/2020 | Lagree |
| 10,857,420 | B2 | 12/2020 | Lagree |
| 10,864,399 | B2 | 12/2020 | Lagree |
| 10,870,034 | B2 | 12/2020 | Lagree |
| 10,881,896 | B2 | 1/2021 | Lagree |
| 10,912,982 | B2 | 2/2021 | Lagree |
| 10,926,127 | B1 | 2/2021 | Lagree |
| 10,940,358 | B2 | 3/2021 | Lagree |
| 10,940,359 | B2 | 3/2021 | Lagree |
| 10,946,230 | B2 | 3/2021 | Lagree |
| 10,957,218 | B1 | 3/2021 | Lagree |
| 10,974,089 | B1 | 4/2021 | Lagree |
| 10,974,092 | B2 | 4/2021 | Lagree |
| 10,994,168 | B2 | 5/2021 | Lagree |
| 11,000,727 | B2 | 5/2021 | Lagree |
| 11,020,627 | B1 | 6/2021 | Lagree |
| 11,040,234 | B2 | 6/2021 | Lagree |
| 2001/0056011 | A1 | 12/2001 | Endelman |
| 2003/0119635 | A1 | 6/2003 | Arbuckle |
| 2005/0130810 | A1 | 6/2005 | Sands |
| 2005/0164856 | A1 | 7/2005 | Parmater |
| 2006/0046914 | A1 | 3/2006 | Endelman |
| 2006/0199712 | A1 | 9/2006 | Barnard |
| 2007/0087921 | A1 | 4/2007 | Graham |
| 2008/0070765 | A1 | 3/2008 | Brown |
| 2008/0248935 | A1 | 10/2008 | Solow |
| 2010/0227748 | A1 | 9/2010 | Campanaro |
| 2011/0009249 | A1 | 1/2011 | Campanaro |
| 2011/0143898 | A1 | 6/2011 | Trees |
| 2011/0166002 | A1 | 7/2011 | Savsek |
| 2011/0172069 | A1 | 7/2011 | Gerschefske |
| 2012/0295771 | A1 | 11/2012 | Lagree |
| 2013/0017935 | A1 | 1/2013 | Endelman |
| 2013/0196835 | A1 | 8/2013 | Solow |
| 2014/0011645 | A1 | 1/2014 | Johnson |
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2015/0024914 | A1 | 1/2015 | Lagree |
| 2015/0057127 | A1 | 2/2015 | Lagree |
| 2015/0065318 | A1 | 3/2015 | Lagree |
| 2015/0072841 | A1 | 3/2015 | Lagree |
| 2015/0141204 | A1 | 5/2015 | Lagree |

(56) References Cited

U.S. PATENT DOCUMENTS

| | | | |
|---|---|---|---|
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0043210 | A9 | 2/2017 | Lagree |
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2017/0304673 | A1 | 10/2017 | Lagree |
| 2017/0326406 | A1 | 11/2017 | Lagree |
| 2017/0340947 | A1 | 11/2017 | Lagree |
| 2017/0354840 | A1 | 12/2017 | Lagree |
| 2018/0015319 | A1 | 1/2018 | Lagree |
| 2018/0021621 | A1 | 1/2018 | Lagree |
| 2018/0021655 | A1 | 1/2018 | Lagree |
| 2018/0036583 | A1 | 2/2018 | Lagree |
| 2018/0056109 | A1 | 3/2018 | Lagree |
| 2018/0056133 | A1 | 3/2018 | Lagree |
| 2018/0111020 | A1 | 4/2018 | Lagree |
| 2018/0111033 | A1 | 4/2018 | Lagree |
| 2018/0117392 | A1 | 5/2018 | Lagree |
| 2018/0133532 | A1 | 5/2018 | Lagree |
| 2018/0133533 | A1 | 5/2018 | Lagree |
| 2018/0133534 | A1 | 5/2018 | Lagree |
| 2018/0133542 | A1 | 5/2018 | Lagree |
| 2018/0178053 | A1 | 6/2018 | Lagree |
| 2018/0193691 | A1 | 7/2018 | Lagree |
| 2018/0207469 | A1 | 7/2018 | Aronson |
| 2018/0250551 | A1 | 9/2018 | Lagree |
| 2018/0250573 | A1 | 9/2018 | Lagree |
| 2018/0272179 | A1 | 9/2018 | Lagree |
| 2018/0280782 | A1 | 10/2018 | Lagree |
| 2018/0318627 | A1 | 11/2018 | Lagree |
| 2018/0318646 | A1 | 11/2018 | Lagree |
| 2018/0326252 | A1 | 11/2018 | Lagree |
| 2018/0353803 | A1 | 12/2018 | Lagree |
| 2018/0361190 | A1 | 12/2018 | Lagree |
| 2018/0361197 | A1 | 12/2018 | Lagree |
| 2019/0083842 | A1 | 3/2019 | Lagree |
| 2019/0160320 | A1 | 5/2019 | Lagree |
| 2019/0160329 | A1 | 5/2019 | Lagree |
| 2019/0232105 | A1 | 8/2019 | Lagree |
| 2019/0240530 | A1 | 8/2019 | Lagree |
| 2019/0247694 | A1 | 8/2019 | Lagree |
| 2019/0247705 | A1 | 8/2019 | Lagree |
| 2019/0247707 | A1 | 8/2019 | Lagree |
| 2019/0255375 | A1 | 8/2019 | Lagree |
| 2019/0269961 | A1 | 9/2019 | Lagree |
| 2019/0314672 | A1 | 10/2019 | Lagree |
| 2019/0358484 | A1 | 11/2019 | Lagree |
| 2020/0030657 | A1 | 1/2020 | Lagree |
| 2020/0047051 | A1 | 2/2020 | Lagree |
| 2020/0054913 | A1 | 2/2020 | Lagree |
| 2020/0078630 | A1 | 3/2020 | Lagree |
| 2020/0078634 | A1 | 3/2020 | Lagree |
| 2020/0171337 | A1 | 6/2020 | Lagree |
| 2020/0188720 | A1 | 6/2020 | Villency |
| 2020/0222741 | A1 | 7/2020 | Aronson |
| 2020/0353306 | A1 | 11/2020 | Lagree |
| 2020/0376326 | A1 | 12/2020 | Lagree |
| 2020/0376359 | A1 | 12/2020 | Lagree |
| 2021/0069542 | A1 | 3/2021 | Lagree |
| 2021/0069572 | A1 | 3/2021 | Lagree |
| 2021/0086023 | A1 | 3/2021 | Lagree |
| 2021/0101048 | A1 | 4/2021 | Lagree |
| 2021/0121734 | A1 | 4/2021 | Lagree |
| 2021/0154555 | A1 | 5/2021 | Lagree |
| 2021/0187343 | A1 | 6/2021 | Lagree |
| 2021/0187345 | A1 | 6/2021 | Lagree |
| 2021/0244993 | A1 | 8/2021 | Singer |

EXERCISE MACHINE WITH ADJUSTABLE PLATFORMS

CROSS REFERENCE TO RELATED APPLICATIONS

The present application is a continuation of U.S. application Ser. No. 17/380,196 filed on Jul. 20, 2021 which issues as U.S. Pat. No. 11,465,011 on Oct. 11, 2022. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

The described example embodiments in general relate to an exercise machine with adjustable platforms for adjusting the angular orientation of an end platform and/or carriage platform to allow for a wide range of exercise moves.

A wide range of exercise machines are available to the modern exerciser. Such exercise machines may commonly be found in exercise studios or in home gyms. One such common exercise machine is commonly referred to as a "reformer", which includes a carriage which is movable against a resistance force. The exerciser will typically mount the carriage and perform various exercise movements against such resistance during a workout.

In the past, the exerciser would typically exercise on a reformer-type machine having a flat-surfaced carriage and, in some cases, one or more flat-surfaced end platforms. Such carriages and end platforms will in some cases include bulky handles which provide different points (other than the upper flat surfaces of the carriage/end platforms themselves) to which an exerciser may place various limbs or grasp during the performance of exercises.

While such previous exercise machines are useful for accommodating a wide range of various exercise movements, they often require either the use of obstructive handles/gripping surfaces or a lack of the same which can inhibit the exercise moves available for the exerciser. It would be desirable for such an exerciser to have adjustable surfaces which can be tilted to function as additional contact/grasping points to allow for additional exercise movements without the use of bulky handles or other structures.

SUMMARY

Some of the various embodiments of the present disclosure relate to an exercise machine with adjustable platforms that can adjust the inclination of both a carriage platform and an end platform between a lowered, flat position and a raised, inclined position. Some of the various embodiments of the present disclosure include an exercise machine having a frame including at least one rail and a carriage movably connected to the at least one rail, with the carriage being adapted to be movable along a portion of the at least one rail. A biasing member is adapted to be connected to the carriage, with the biasing member being adapted to apply a resistance force against movement of the carriage in at least one direction. A first end platform is pivotably connected to the frame, with a first end of the first end platform being adjustable between a level position with respect to the frame and a raised position with respect to the frame. An upper surface of the first end platform is parallel with respect to an upper surface of the carriage when the first end platform is in the level position, and the upper surface of the first end platform is not parallel with respect to the upper surface of the carriage when the first end platform is in the raised position. In some embodiments, a second end platform may be connected to the frame, with the second end platform being similarly adjustable between a level position and a raised position. In some other embodiments, the carriage may be split between a first platform and a second platform, with the first and/or second platforms being themselves adjustable between a raised position and a level position.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Some of the various embodiments of the present disclosure relate to an exercise machine with adjustable platforms that includes one or more end platforms 40*a*, 40*b* may be adjusted between a level position and one or more raised positions and a carriage 20 including one or more platforms 21, 21 that may be adjusted between a level position and one or more raised positions. Some of the various embodiments of the present disclosure include a rail 16*a*, 16*b* to which a carriage 20 is movably connected and a first end platform 40*a* connected to an end of the rail 16*a*, 16*b*. The carriage 20 includes a platform 23 which may be adjusted between a level position in which the platform 23 is laid flat and a raised position in which the platform 23 is at an angular incline. In some example embodiments, the first end platform 40*a* may similarly and independently be adjustable between the level position in which the first end platform 40*a* is laid flat and a raised position in which the first end platform 40*a* is at an angular incline. In some other example embodiments, the exercise machine 10 may include a second end platform 40*b* which is similarly adjustable between a level position and a raised position.

Figure 1:
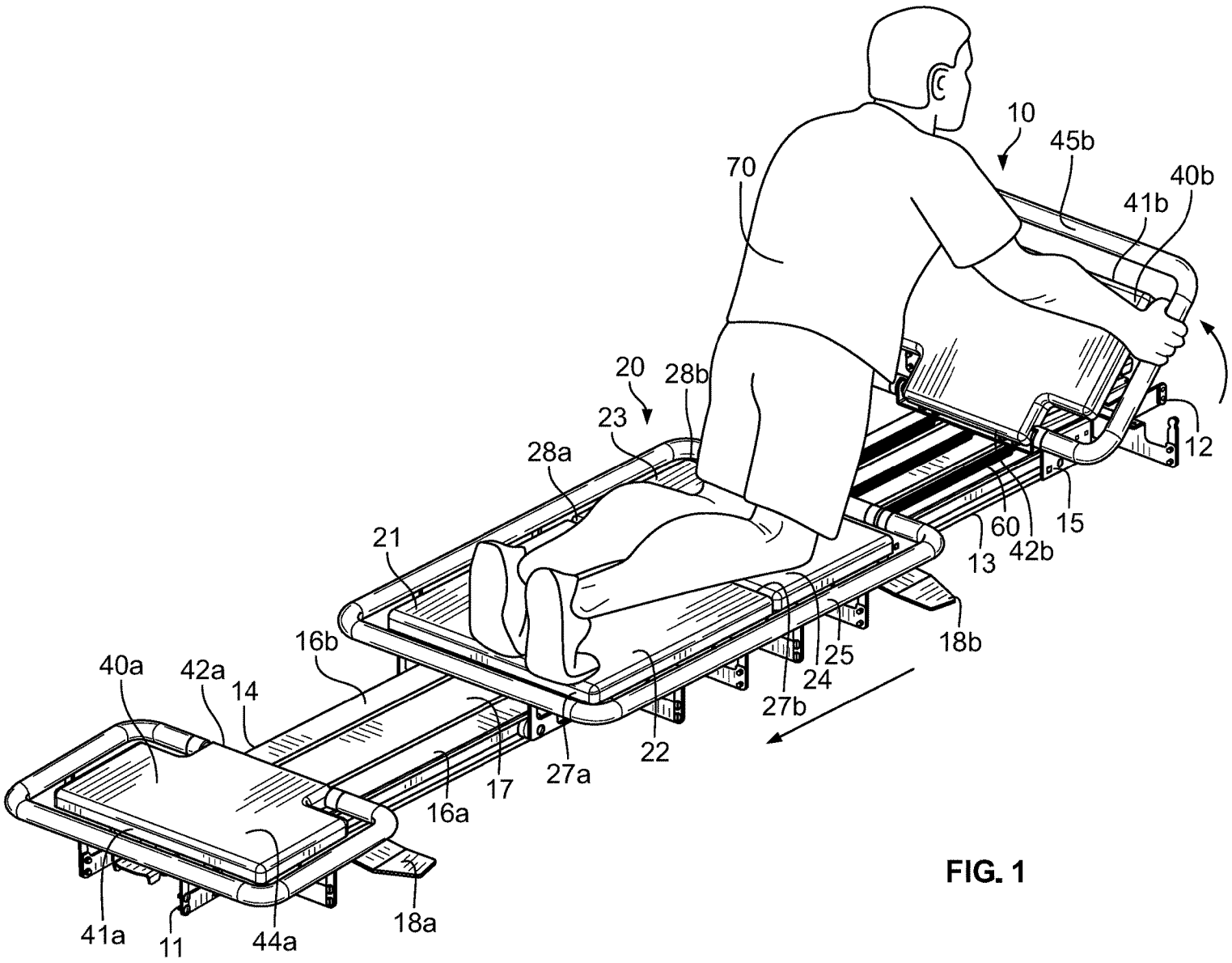
FIG. 1 is an upper perspective view of an exercise machine with adjustable platforms in use with an end platform raised in accordance with an example embodiment.

As shown in FIG. 1, an example embodiment of an exercise machine 10 may include a frame 15 including at least one rail 16*a*, 16*b* and a carriage 20 movably connected to the at least one rail 16*a*, 16*b*, with the carriage 20 being adapted to be movable along a portion of the at least one rail 16*a*, 16*b*. A biasing member 60 is adapted to be connected to the carriage 20, with the biasing member 60 being adapted to apply a resistance force against movement of the carriage 20 in at least one direction. A first end platform 40*a* may be pivotably connected to the frame 15, with the first end platform 40*a* being adjustable between a level position with respect to the frame 15 and a raised position with respect to the frame 15.

An upper surface 44*a* of the first end platform 40*a* may be parallel with respect to an upper surface 22, 24 of the carriage 20 when the first end platform 40*a* is in the level position and not parallel with respect to the upper surface 22, 24 of the carriage 20 when the first end platform 40*a* is in the raised position. An outer end 41*a* of the first end platform 40*a* is raised with respect to an inner end 42*a* of the first end platform 40*a* when the first end platform 40*a* is in the raised position. An angle of the upper surface 44*a* of the first end platform 40*a* is greater than zero degrees with respect to the upper surface 22, 24 of the carriage 20 when the first end platform 40*a* is in the raised position. An angle of the upper surface 44*a* of the first end platform 40*a* may be ninety degrees with respect to the upper surface 22, 24 of the carriage 20 when the first end platform 40*a* is in the raised position.

The first end platform 40*a* may be pivotably connected to the frame 15 closer to an inner end 42*a* of the first end platform 40*a* than an outer end 41*a* of the first end platform 40*a*. The upper surface 44*a* of the first end platform 40*a* may share a common plane with the upper surface 22, 24 of the carriage 20 when the first end platform 40*a* is in the level position. One or more handles 45*a*, 48*a*, 48*b* may be connected to the first end platform 40*a*. A perimeter handle 45*a* of the end platform 40*a* may function as a first handle connected to a first side of the end platform 40*a*, a second handle connected to a second side of the end platform, and a third handle connected to an outer end 41*a* of the end platform 40*a*, with the first, second, and third handles being continuous to form the perimeter handle 45*a*.

A pivot connector 50*a* such as a bracket may be connected between the frame 15 and the first end platform 40*a*, with a first end 51*a* of the pivot connector 50*a* being pivotably connected to the frame 15 and a second end 52*a* of the pivot connector 50*a* being pivotably connected to the first end platform 40*a*. The first end platform 40*a* may be adapted to be releasably locked in a plurality of positions. The end platform 40*a* may include a locking member 54*a* including a plurality of slots 55*a*, with the locking member 54*a* being adapted to releasably lock the first end platform 40*a* in the plurality of positions. A release member 53*a* may be movably connected between the first end platform 40*a* and the locking member 54*a*, with the release member 53*a* being adapted to release the first end platform 40*a* from each of the plurality of positions.

In an exemplary embodiment, the exercise machine 10 may also include a second end platform 40*b* pivotably connected at or near a second end 12 of the frame 15, with the second end platform 40*b* being adjustable between a second level position with respect to the frame 15 and a second raised position with respect to the frame 15. The second upper surface 44*b* of the second end platform 40*b* may be parallel with respect to the upper surface 22, 24 of the carriage 20 when the second end platform 40*b* is in the second level position and not parallel with respect to the upper surface 22, 24 of the carriage when the second end platform 40*b* is in the second raised position.

The first end platform 40*a* and the second end platform 40*b* may each be individually adjustable. The first end platform 40*a* may be adapted to pivot in a first direction and the second end platform 40*b* may be adapted to pivot in a second, opposite direction. The upper surface 44*a* of the first end platform 40*a* may share a common plane with the upper surface 44*b* of the second end platform 40*b* when the first end platform 40*a* is in the level position and the second end platform 40*b* is in the second level position.

An exemplary method of using the exercise machine 10 may include the steps of pivoting the first end platform 40*a* from the level position to the raised position, locking the first end platform 40*a* in the raised position, placing a body portion on the first end platform 40*a*, and moving the carriage 20 along the at least one rail 16*a*, 16*b*.

B. Frame

As shown throughout the figures, the systems and methods described herein may be utilized in combination with an exercise machine 10 adapted for use by one or more exercisers to perform one or more exercise movements. The type of exercise machine 10 utilized may vary in different embodiments, and thus the exercise machine 10 may comprise various shapes, sizes, and configurations. The shape, size, and configuration of the exercise machine 10 should thus not be construed as limited by the exemplary figures.

The figures illustrate an exemplary exercise machine 10 which may be utilized in connection with the systems and methods described herein. The exercise machine 10 may be comprised of various types of exercise machines such as but not limited to a reformer exercise machine, exercise bicycle, rowing machine, elliptical trainer, treadmill, and the like. It should be appreciated that the exemplary embodiments shown in the figures are merely for illustrative purposes, and thus the scope should not be construed as limited to any particular exercise machine configuration shown in the figures.

Figure 2:
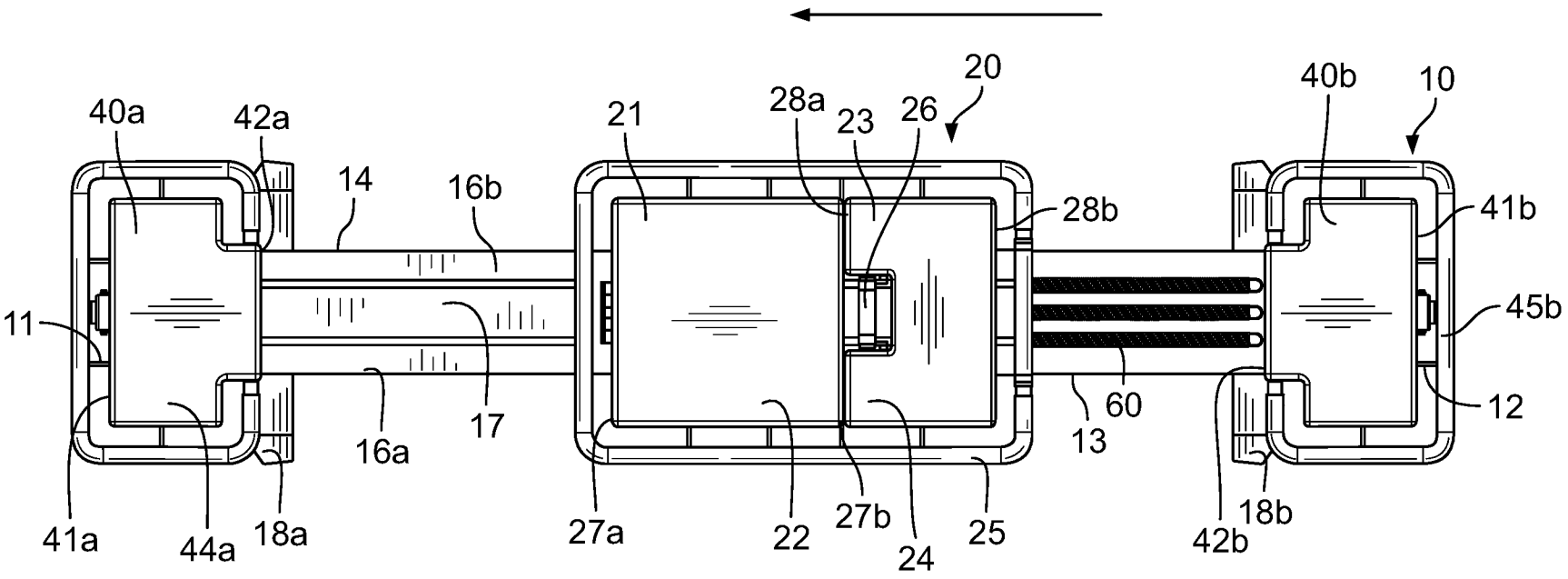
FIG. 2 is a top view of an exercise machine with adjustable platforms in accordance with an example embodiment.
Figure 3:
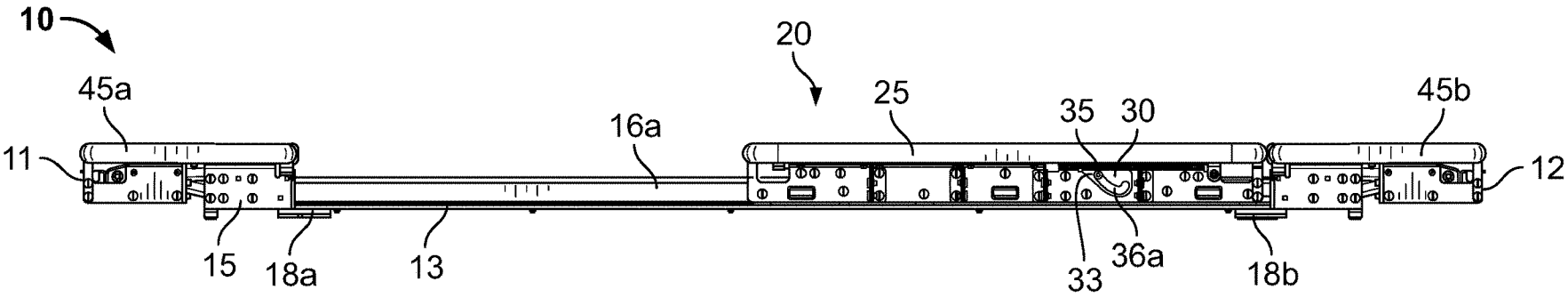
FIG. 3 is a side view of an exercise machine with adjustable platforms in accordance with an example embodiment.

As best shown in FIGS. 1 and 2, the exercise machine 10 may comprise a first end 11, a second end 12, a first side 13, and a second side 14. The exercise machine 10 may comprise various structural elements which together form a frame 15. Generally, the exercise machine 10 will be comprised of both fixed elements (e.g., legs 18*a*, 18*b*, frame 15, and rails 16*a*, 16*b*) and movable elements (e.g., carriage 20 and end platform 16). The frame 15 may comprise both fixed elements and movable elements in an exemplary embodiment.

The exercise machine 10 may comprise at least one rail 16*a*, 16*b* upon which a carriage 20 may be movably positioned such that the carriage 20 may be moved in at least one direction (e.g., towards the first end 11 and/or towards the second end 12). In the exemplary embodiment shown in FIGS. 1 and 2, the frame 15 of the exercise machine 10 is illustrated as comprising a pair of rails 16*a*, 16*b*, with a first rail 16*a* extending at least partially between the first and second ends 11, 12 of the exercise machine 10 along its first side 13 and a second rail 16*b* extending at least partially between the first and second ends 11, 12 of the exercise machine 10 along its second side 14.

It should be appreciated that the number of rails 16*a*, 16*b* utilized may vary in different embodiments. In some embodiments, a pair of rails 16*a*, 16*b* comprising a first rail 16*a* and a second rail 16*b* which is parallel with the first rail 16*a* may be utilized. In other embodiments, a single monorail may be utilized which is positioned centrally between the first and second sides 13, 14 of the exercise machine 10. In yet another embodiments, multiple rails 16*a*, 16*b* may be utilized in combination with a spacer 17 to create the appearance of a monorail configuration.

In the exemplary embodiment best shown in FIG. 1, it can be seen that the frame 15 includes a first rail 16*a*, a second rail 16*b*, spacers 17, and lower members 19 connected between the first and second rails 16*a*, 16*b*. Such an embodiment allows for structures internal to the rails 16*a*, 16*b*, such as the biasing members 60, to be at least partially enclosed. Such a configuration prevents inadvertent injury by, for example, an exerciser 70 inadvertently placing a limb between the rails 16*a*, 16*b* to get caught in the biasing members 60 or other internal structures.

As best shown in FIGS. 1, 2, 11, and 12, the rails 16*a*, 16*b* may be enclosed at their upper ends by one or more spacers 17 and at their lower ends by one or more lower members 19. However, in some embodiments, the spacers 17 may be omitted, with the space between the rails 16*a*, 16*b* being exposed.

As best shown in FIGS. 1, 2, 11, and 12, the exercise machine 10 will generally include a pair of rails 16*a*, 16*b* on which a carriage 20 may be movably connected. The shape, size (e.g., length and width), positioning, and orientation of the rails 16*a*, 16*b* may vary in different embodiments, and thus should not be construed as limited by the exemplary embodiments shown in the figures. Through the use of spacers 17, the pair of rails 16*a*, 16*b* may have the appearance of a single monorail such as shown in FIGS. 1 and 2.

Each of the rails 16*a*, 16*b* generally comprise an elongated member. The material utilized for the rails 16*a*, 16*b* may vary in different embodiments. The rails 16*a*, 16*b* may be comprised of various metals, metal alloys, plastics, woods, and/or composite materials in different embodiments. The rails 16*a*, 16*b* may be substantially tubular, with a hollow interior.

The rails 16*a*, 16*b* may be parallel to each other, or may be slightly angled away from or towards each other. The spacing between the rails 16*a*, 16*b* will vary in different embodiments. As shown in FIGS. 1, 2, 3, 11, 12, and 17, a first rail 16*a* may extend between the first and second ends 11, 12 of the exercise machine 10 at or near the first side 13 of the exercise machine 10. The first rail 16*a* may extend the full length of the exercise machine 10 between the first and second ends 11, 12 thereof, or may extend for less than the full length of the exercise machine 10.

As shown in FIGS. 1, 2, 11, 12, and 17, a second rail 16*b* may extend between the first and second ends 11, 12 of the exercise machine 10 at or near the second side 14 of the exercise machine 10. The second rail 16*b* may extend the full length of the exercise machine 10 between the first and second ends 11, 12 thereof, or may extend for less than the full length of the exercise machine 10.

C. Carriage

As shown throughout the figures, the exercise machine 10 generally includes a carriage 20 which is movably positioned upon the first and second rails 16*a*, 16*b* such that the carriage 20 may move along at least a portion of the length of the first and second rails 16*a*, 16*b*. In an exemplary embodiment, the carriage 20 is adapted to move back and forth along at least a portion of the length of the first and second rails 16*a*, 16*b* in a reciprocating manner. The carriage 20 typically includes a plurality of wheels or other movable structures that movably engage with the first and second rails 16*a*, 16*b* of the exercise machine 10. The lower surface of the carriage 20 may be positioned over the first and second rails 16*a*, 16*b*, which function as a track for the carriage 20 to move along.

The carriage 20 may include various handles, cutouts, and the like which an exerciser 70 may grasp or contact with various limbs during the performance of a wide range of exercises. In the exemplary embodiment shown in FIG. 16, the carriage 20 is shown as including a perimeter handle 25 surrounding the carriage 20. The perimeter handle 25 may extend around both the first and second platforms 21, 23 of the carriage 20 such as shown in the figures. It should be appreciated that such a configuration is merely for exemplary purposes, and thus should not be construed as limiting in scope.

The shape, size, and configuration of the carriage 20 may vary in different embodiments, and thus should not be construed as limited by the exemplary embodiments shown in the figures. The carriage 20 will generally comprise a substantially-rectangular shape such as shown in the figures, though other shapes may be utilized in different embodiments. The length and width of the carriage 20 may vary depending on the embodiment so as to suit different types of exercisers 70. A large bodybuilder would benefit from a longer and wider carriage 20 than a more cardio-based exerciser 70 with perhaps a smaller stature. Thus, the dimensions of the carriage 20 shown in the exemplary figures should not be construed as limiting in scope.

U.S. Pat. Nos. 10,716,964, 10,155,129, 9,604,095, 9,579,555 and 7,803,095 disclose example exercise machines with a movable carriage, the entire disclosures of which, except for any definitions, disclaimers, disavowals, and inconsistencies, are incorporated herein by reference.

As shown in the figures, the carriage 20 will generally be movably positioned or connected to the first and second rails 16*a*, 16*b*. The manner in which the carriage 20 is movably positioned or connected to the first and second rails 16*a*, 16*b* may vary in different embodiments. In some embodiments, portions of the carriage 20 may mate with the first and second rails 16*a*, 16*b* such that the carriage 20 may slide upon the first and second rails 16*a*, 16*b*. In other embodiments, magnets such as magnetic levitation may be utilized.

The carriage 20 may be movable in at least two respects. As previously mentioned, the carriage 20 may be movable (e.g., slidable) along one or more rails 16*a*, 16*b*. One or more biasing members 60 may be fixedly or removably connected to the carriage 20 so as to impart a resistance force against such movement along the one or more rails 16*a*, 16*b*. The resistance force applied against movement of the carriage 20 may be varied in certain embodiments, such as by selectively attaching or removing one or more biasing members 60 to/from the carriage 20.

In addition to be movable along the one or more rails 16*a*, 16*b*, one or more portions of the carriage 20 may be adjustable with respect to the frame 15. More specifically, one or more portions of the carriage 20 may be adapted to pivot with respect to the frame 15 between a level position, in which one or more portions of the carriage 20 are parallel to the frame 15, and one or more raised positions, in which one or more portions of the carriage 20 are angled or inclined with respect to the frame 15. Such a configuration allows for portions of the carriage 20 to function as handles or gripping points to allow for a wider range of exercise movements, particularly with carriages 20 that may not have discrete handles.

Figure 5:
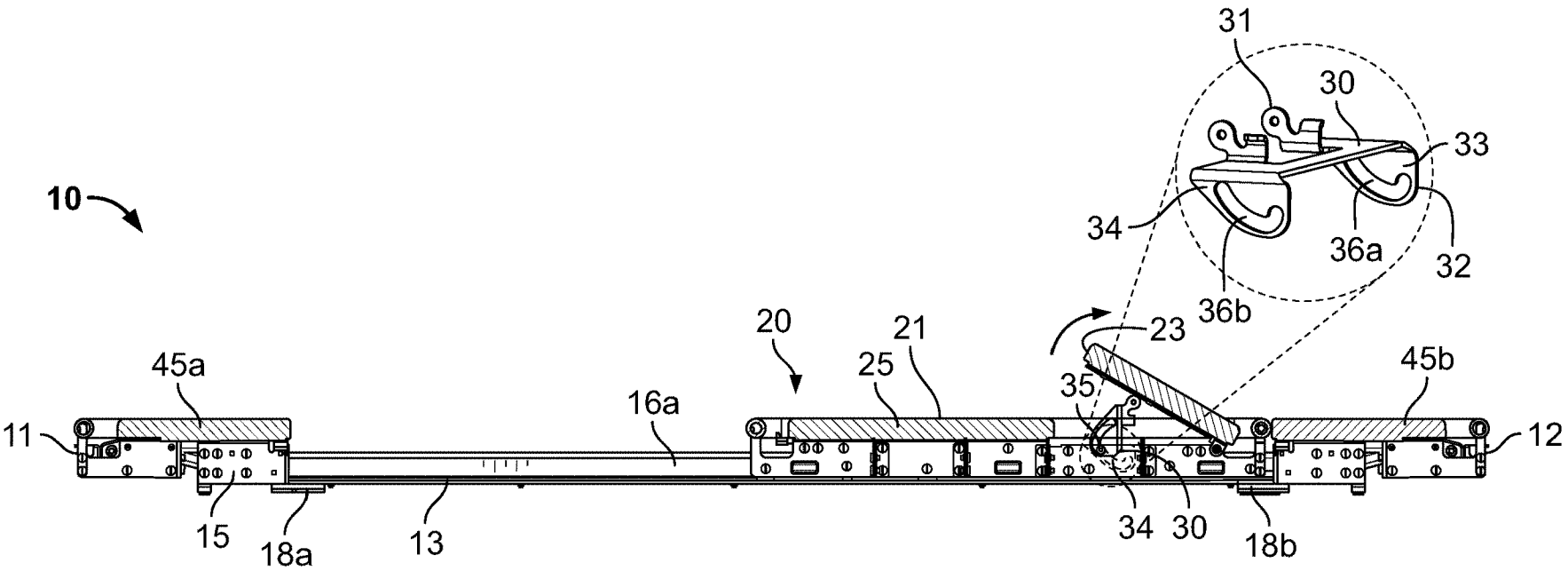
FIG. 5 is a side sectional view of an exercise machine with adjustable platforms with a carriage platform raised in accordance with an example embodiment.
Figure 6:
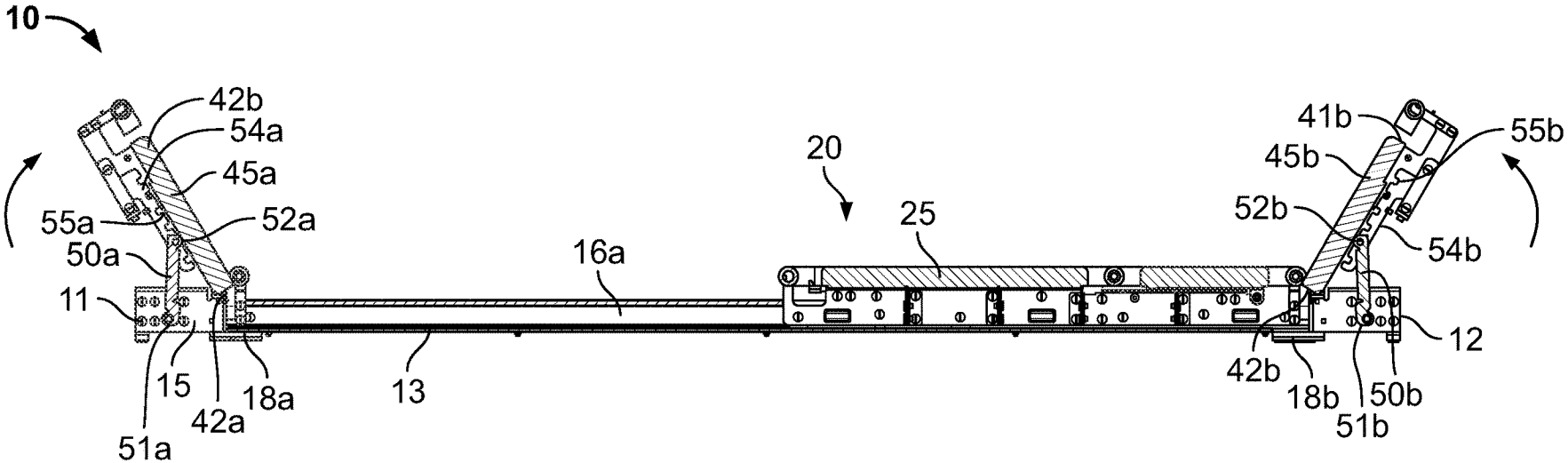
FIG. 6 is a side sectional view of an exercise machine with adjustable platforms with both end platforms in a raised position in accordance with an example embodiment.
Figure 7:
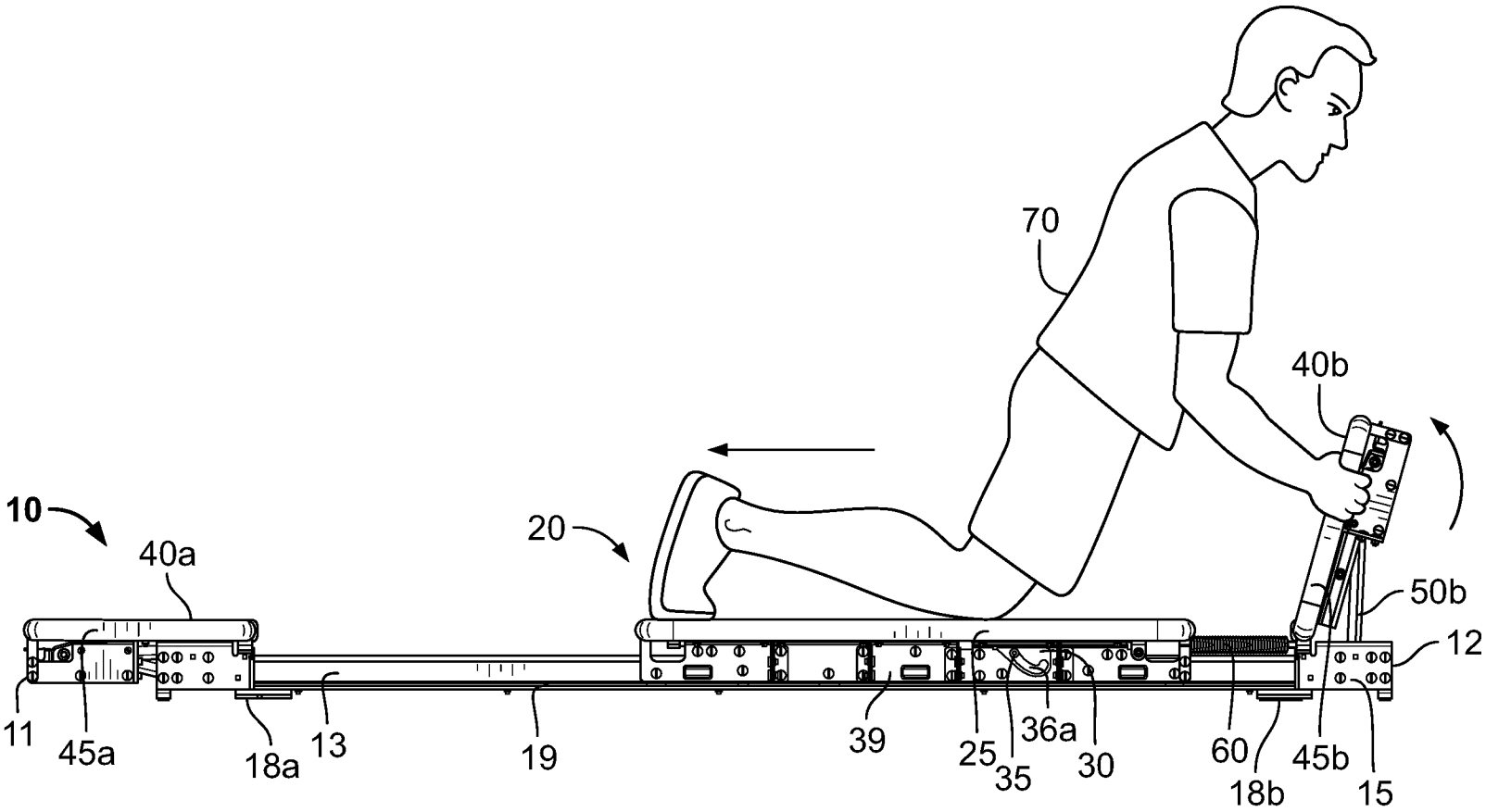
FIG. 7 is a side view of an exercise machine with adjustable platforms in use with an end platform in a raised position in accordance with an example embodiment.

As shown in FIGS. 5 and 6, the carriage 20 may comprise a split carriage including a first platform 21 and a second platform 23. The first platform 21 may be positioned adjacent to the second platform 23 such as shown in the figures. In certain embodiments, however, a larger space may be present between the first and second platforms 21, 23 than is shown in the exemplary embodiment shown in the figures. Thus, the spacing of the first and second platforms 21, 23 of the carriage 20 shown in the figures should not be construed as limiting in scope. It should also be appreciated that, in some embodiments, the carriage 20 may comprise only a single platform 21, with that platform 21 being adjustable between a level position and one or more raised positions.

The carriage 20 will generally comprise a frame 39 to which the one or more platforms 21, 23 are attached. In the embodiment shown in the figures, the first platform 21 is fixedly attached to the frame 39 of the carriage 20, and the second platform 23 is adjustable (e.g., pivotably) attached to the frame 39 of the carriage 20. Thus, the second platform 23 is adjustable (e.g., pivotably) with respect to the frame 39 of the carriage 20. It should be appreciated, as mentioned previously, that the reverse configuration may be utilized in certain embodiments. In such embodiments, the first platform 21 may instead be pivotable with respect to the frame 39 of the carriage 20. In a further example embodiments, both platforms 21, 23 may be adjustably connected to the frame 39 of the carriage 20 so as to pivot with respect to the frame 39 of the carriage 20.

The frame 39 of the carriage 20 will generally comprise various structural elements. By way of example, the frame 39 of the carriage 20 may comprise one or more wheel supports to which wheels 38 may be rotatably connected, with the wheels 38 being used to move the carriage 20 along the at least one rail 16*a*, 16*b*. The frame 39 may also comprise various bars or other fixed structures to which the platforms 21, 23 may be connected.

It should also be appreciated that the carriage 20 should not be construed as limited to a pair of platforms 21, 23, as additional platforms may be utilized in certain embodiments (e.g., the carriage 20 could have 3, 4, 5, 6, or more platforms). In such embodiments including more than the two platforms 21, 23, any combination of such additional platforms may be adjustable in the manner described herein. By way of non-limiting example, in an embodiment in which the carriage 20 includes three platforms, two of the platforms could be adjustable, and one of the platforms could be fixed, or vice versa.

In the exemplary embodiment best shown in FIGS. 1, 2, 11, 12, and 17, it can be seen that the first platform 21 includes an upper surface 22, a first end 27*a*, and a second end 28*a*. The first end 27*a* of the first platform 21 faces towards the first end 11 of the exercise machine 10 and the second end 28*a* of the first platform 21 faces towards the second end 12 of the exercise machine 10.

Continuing to reference FIGS. 1, 2, 11, 12, and 17, it can be seen that the second platform 23 similarly includes an upper surface 24, a first end 27*b*, and a second end 28*b*. The first end 27*b* of the second platform 23 faces towards the first end 11 of the exercise machine 10 and the second end 28*b* of the second platform 23 faces towards the second end 12 of the exercise machine 10.

Generally, the second end 28*a* of the first platform 21 is positioned adjacent to the first end 27*b* of the second platform 23 such as shown in the figures. The distance between the respective second end 28*a* of the first platform 21 and the first end 27*b* of the second platform 23 may vary in different embodiments. In some embodiments, when in the level position, the first and second platforms 21, 23 may touch each other. In other embodiments, there may be a gap between the first and second platforms 21, 23. The size of such a gap, if present, may vary in different embodiments and should not be construed as limited by the exemplary figures.

In the exemplary embodiment shown in the figures, it can be seen that the first platform 21 is fixed at a level position, and that the second platform 23 is adjustable (e.g., pivotable) between a level position and a raised position. It should be appreciated, however, that in certain embodiments the reverse configuration may be utilized. In such embodiments, the first platform 21 may be adjustable between a level position and a raised position, and the second platform 23 may be fixed at a level position. In yet other embodiments, both the first and second platforms 21, 23 may be individually adjustable between the level and raised positions.

In the figures, the second platform 23 is illustrated as pivoting about its second end 28*b*, with the first end 27*b* of the second platform 23 being raised or lowered when adjusting between the level and raised positions. Thus, in the exemplary embodiment shown in the figures, the second platform 23 is raised by pivoting in a clockwise direction and lowered by pivoting in a counterclockwise direction.

It should be appreciated, however, that the reverse configuration may be utilized in certain embodiments. Thus, in some embodiments, the second platform 23 may instead pivot about its first end 27*b*, with the second end 28*b* being raised or lowered when adjusting between the level and raised positions. In such embodiments, the second platform 23 is raised by pivoting in a counterclockwise direction and lowered by pivoting in a clockwise direction. The same applies to the first platform 21 in embodiments in which the first platform 21 is adjustable.

In the exemplary embodiment shown in the figures, the second end 28*b* of the second platform 23 is shown as being pivotably connected to the frame 39 of the carriage 20. It should be appreciated, as previously mentioned, that in some embodiments, the first end 27*b* of the second platform 23 may instead be pivotably connected to the frame 39 of the carriage 20. The manner in which the first or second end 27*b*, 28*b* of the second platform 23 is pivotably connected to the frame 39 of the carriage 20 may vary in different embodiments. By way of example and without limitation, various pins, fasteners, brackets, and the like may be utilized for the pivotable connection between the second platform 23 and the frame 39 of the carriage.

Figure 11:
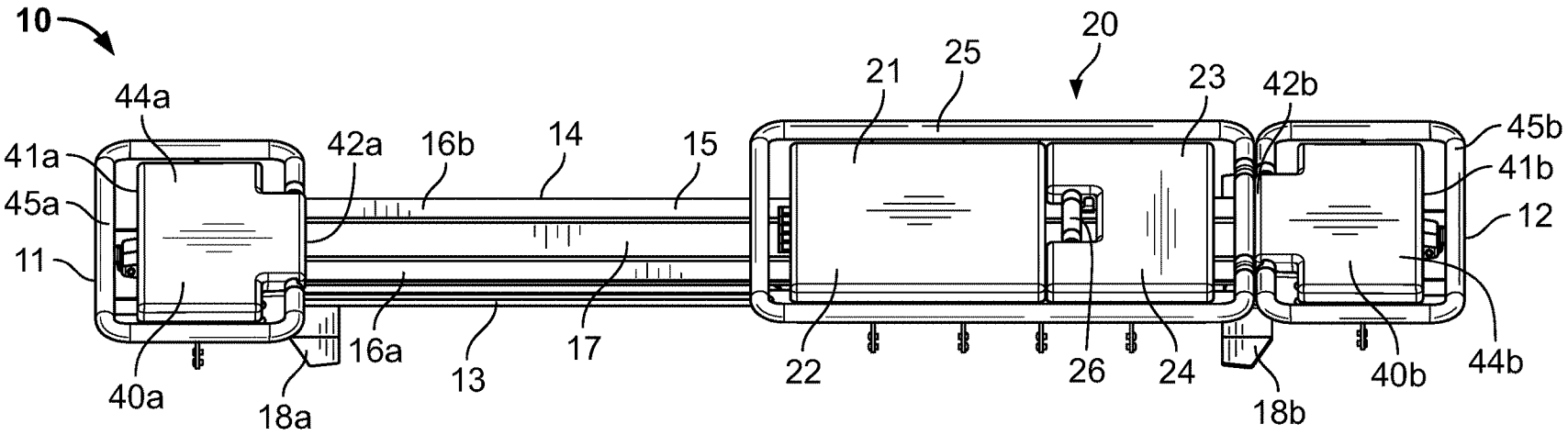
FIG. 11 is a side perspective view of an exercise machine with adjustable platforms in accordance with an example embodiment.
Figure 12:
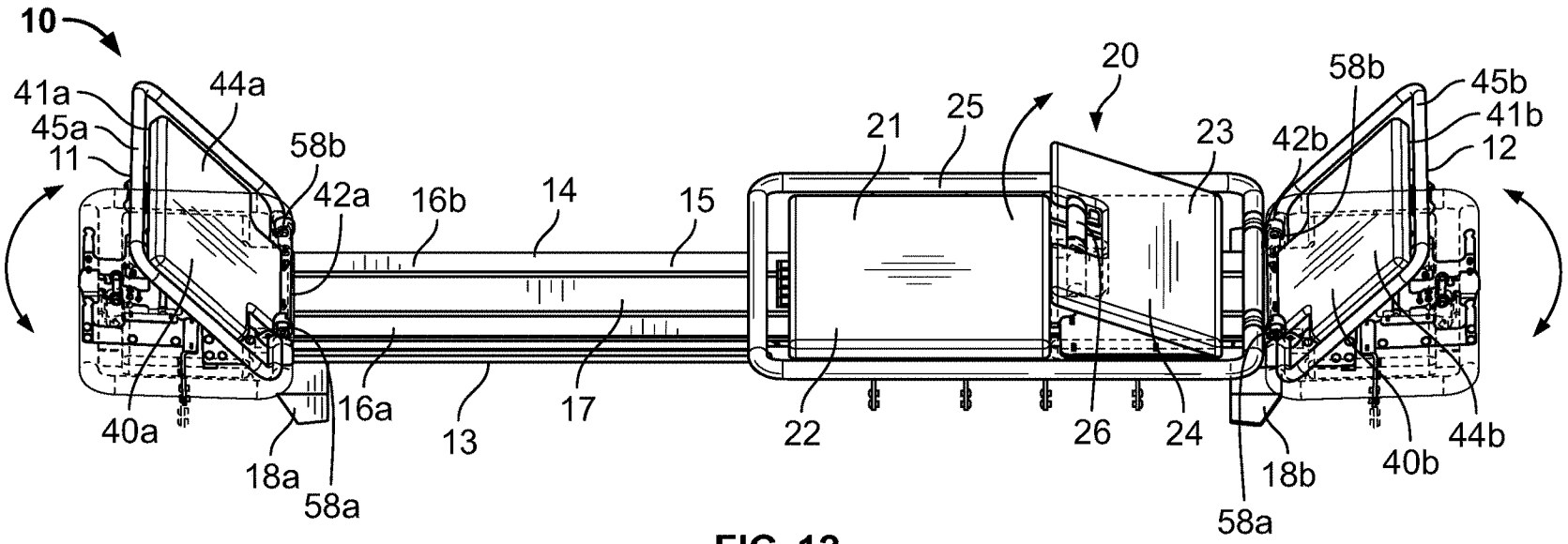
FIG. 12 is a side perspective view of an exercise machine with adjustable platforms with both end platforms and a carriage platform in a raised position in accordance with an example embodiment.

As shown in FIGS. 11 and 12, the first end 27*a* of the first platform 21 may include resistance selectors adapted to engage with one or more biasing members 60 so as to impart a resistance force against movement of the carriage 20 in one or more directions. However, it should be appreciated that the resistance selectors may be positioned at various other locations of the carriage 20, including but not limited to the second platform 23. Various types of resistance selectors may be utilized in different embodiments. Further, it should be appreciated that, in some embodiments, the resistance selectors may instead be connected to the second platform 23. U.S. Pat. No. 10,994,168 discloses an example exercise machine with a resistance selector system, the entire disclosure of which, except for any definitions, disclaimers, disavowals, and inconsistencies, is incorporated herein by reference.

With reference to FIGS. 4, 5, 8-10, 12, and 16, it can be seen that the second platform 23 may be adjustable between a first, level position and a second, raised position. The range of movement of the second platform 23 may vary in different embodiments and should not be construed as limited by the exemplary figures. In some embodiments, the raised position may comprise a position in which the upper surface 24 of the second platform 23 is ninety degrees with respect to the upper surface 24 of the first platform 21. In other embodiments, the second platform 23 may be adjustable to greater than ninety degrees with respect to the first platform 21. In some embodiments, adjusting the second platform 23 past the ninety degree point may function to disengage the second platform 23 or portions there of the carriage 20 (e.g., the wheels 38) to allow service of the carriage 20.

In yet other embodiments, the raised position of the second platform 23 may be various other angles with respect to the first platform 21. For example and without limitation, the raised position of the second platform 23 may comprise the upper surface 24 of the second platform 23 being 5, 10, 15, 20, 25, 30, 35, 40, 45, 50, 55, 60, 65, 70, 75, 80, 85, or 90 degrees with respect to the upper surface 22 of the first platform 21, or any angles therebetween.

The second platform 23 may be releasably locked in various raised positions. In some embodiments, the second platform 23 may only be lockable in two positions: the level position and a single raised position. In other embodiments, the second platform 23 may be lockable between any number of positions, such as between the level position and multiple, discrete raised positions. By way of example and without limitation, in some embodiments, the second platform 23 may be lockable between a first, level position and multiple raised positions, such as raised positions at angular increments (e.g., the second platform 23 could be lockable in 15 degree increments).

The manner in which the one or more platforms 21, 23 of the carriage 20 are adjustable between various positions may vary in different embodiments. In the exemplary embodiment shown in the figures, it can be seen that a bracket 30 is connected between the second platform 23 and the frame 39 of the carriage 20, with the bracket 30 allowing the second platform 23 to be pivotably adjusted with respect to the frame 39 of the carriage 20.

The shape, size, and configuration of such a bracket 30 should not be construed as limited by the exemplary embodiment shown in the figures. As best shown in FIG. 5, the bracket 30 may include a first end 31, a second end 32, a first side 33, and a second side 34. The first end 31 of the bracket 30 is generally connected to the second platform 23 (or, in some embodiments, the first platform 21) and the second end 32 of the bracket 30 is generally connected to the carriage 20 (e.g., to the frame 39 of the carriage 20).

Continuing to reference FIG. 5, it can be seen that the first side 33 of the bracket 30 includes a first slot 36*a* and that the second side 34 of the bracket 30 includes a second slot 36*b*. In some embodiments, however, only a single slot 36*a*, 36*b* may be utilized. Each of the slots 36*a*, 36*b* are illustrated as comprising a J-shape, however other shapes may be utilized, such as but not limited to an L-shape.

The slots 36*a*, 36*b* may be configured so as to lock the second platform 23 in various positions. In the exemplary embodiment, it can be seen that the slots 36*a*, 36*b* are shaped so as to lock the second platform 23 in the raised position at the distal end of the J-shape. In certain embodiments, the slots 36*a*, 36*b* may each include multiple projections or indentations which are utilized to lock the second platform 23 in multiple, discrete positions as-needed.

Figure 4:
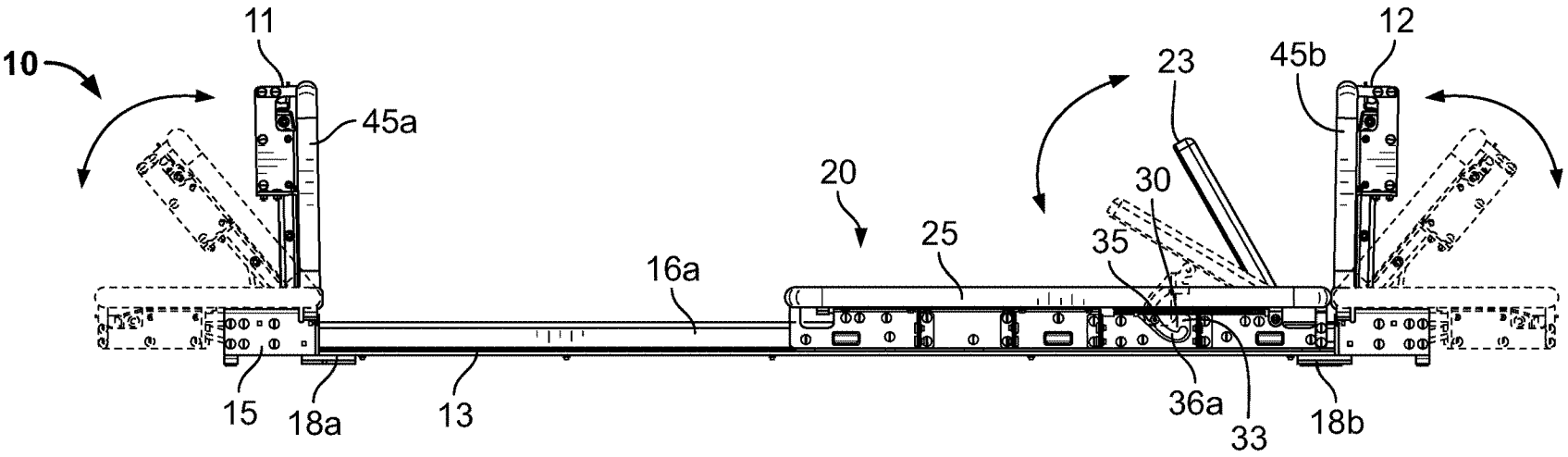
FIG. 4 is a side view of an exercise machine with adjustable platforms with both platforms adjusted into an inclined position in accordance with an example embodiment.
Figure 16:
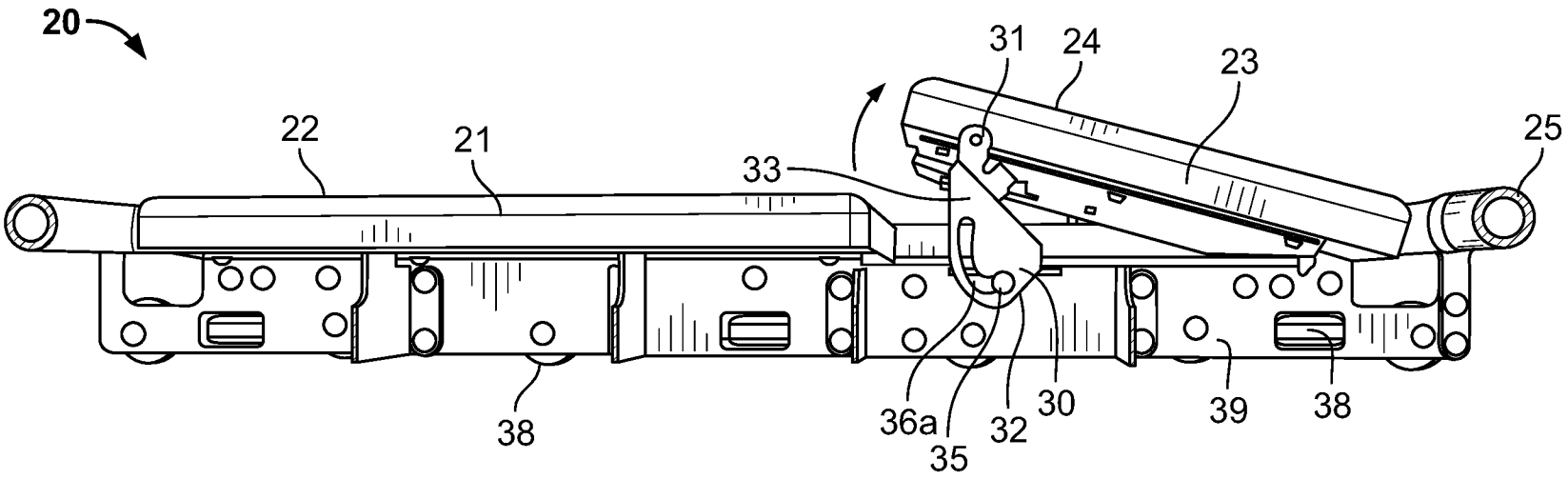
FIG. 16 is a side view of a carriage with a carriage platform in a raised position of an exercise machine with adjustable platforms in accordance with an example embodiment.

With reference to FIG. 16, it can be seen that the exercise machine 10 includes a pair of pivot members 35 over which the bracket 30 moves (e.g., by sliding). However, in certain embodiments, the pivot members 35 may themselves move within the slots 36*a*, 36*b* of the bracket 30. Generally, each of the pivot members 35 will be connected to the frame 15 of the exercise machine 10 such as shown in FIGS. 4, 5, and 16. Thus, a first pivot member 35 may be connected to a first side of the frame 15 of the exercise machine 10 and a second pivot member 35 may be connected to a second side of the frame 15 of the exercise machine 10.

In such embodiments, the first side 33 of the bracket 30 is movably connected to the first pivot member 35 such that the first pivot member 35 slides within the first slot 36*a* and the second side 34 of the bracket 30 is movably connected to the second pivot member 35 such that the second pivot member 35 slides within the second slot 36*b*. As mention previously, however, the reverse configuration may be utilized in certain embodiments.

The type of pivot members 35 utilized may vary in different embodiments. By way of example and without limitation, the pivot members 35 may each be comprised of an elongated member such as a fastener, pin, bolt, nut, projection, or the like. While the figures illustrate that the pivot members 35 are on the outer sides of the frame 15 of the exercise machine 10, it should be appreciated that, in some embodiments, the pivot members 35 may instead be on the inner sides of the frame 15 of the exercise machine 10.

The exemplary embodiment shown in the figures illustrates a pair of pivot members 35 connected to the sides of the carriage 20. More specifically, the pivot members 35 may each be connected to the frame 39 of the carriage 20. However, in some embodiments, the pivot members 35 may instead be connected to the second platform 23 such that the pivot members 35 slide within the slots 36*a*, 36*b*, rather than the slots 36*a*, 36*b* sliding over the pivot members 35.

As best shown in FIG. 2, the carriage 20 may include a perimeter handle 25 which extends around both the first platform 21 and the second platform 23. Additionally, the carriage 20 may also have a central handle 26 which is connected the first platform 21 and/or the second platform 23. In the embodiment shown in the figures, the central handle 26 is connected to the second platform 23. Such a central handle 26 may be utilized for multiple purposes. For example, the central handle 26 may be grasped to raise the second platform 23 into one or more raised positions or lower the second platform 23 into one or more raised positions and/or the level position.

The sizes of the respective first and second platforms 21, 23 may also vary in different embodiments. In the exemplary embodiment shown in the figures, the first and second platforms 21, 23 have the same width. In certain embodiments, the first and second platforms 21, 23 may have different widths. Additionally, the figures illustrate an embodiment in which the first platform 21 has a greater length than the second platform 23. It should be appreciated that, in certain embodiments, the length of the second platform 23 may be greater than the length of the first platform 21. In yet other embodiments, the first and second platforms 21, 23 may comprise the same length.

In the exemplary embodiment shown in the figures, it can be seen that the second platform 23 of the carriage 20 is raised and lowered independently of the perimeter handle 25 (e.g., the perimeter handle 25 is not raised or lowered with the second platform 23). However, in some embodiments, the perimeter handle 25 may raise or lower with the second platform 23 when the second platform 23 is itself raised or lowered.

D. End Platforms

As shown throughout the figures, the exercise machine 10 may include a first end platform 40*a* positioned at a first end 11 of the exercise machine 10 and/or a second end platform 40*b* positioned at a second end 12 of the exercise machine 10. While the figures illustrate a pair of end platforms 40*a*, 40*b*, it should be appreciated that, in some embodiments, only a single end platform 40*a*, 40*b* may be utilized. As discussed in more detail below, one or both of the end platforms 40*a*, 40*b* may be adjustable between a first, level position and a second, raised position. In the level position, the end platforms 40*a*, 40*b* are laid flat or substantially flat. In the raised position, the end platforms 40*a*, 40*b* are angled at an incline.

In the figures, both end platforms 40*a*, 40*b* are illustrated as being individually adjustable between level and raised positions. It should be appreciated, however, that in some embodiments, one end platform 40*a* could be fixed and the other end platform 40*b* could be adjustable. It is also shown in the figures that the end platforms 40*a*, 40*b* are identical, mirror copies of each other structurally. In some embodiments, the end platforms 40*a*, 40*b* may differ structurally. However, it should be appreciated that any discussion of features or functions of one end platform 40*a* are equally applicable to the other end platform 40*b*, and vice versa.

While each of the end platforms 40*a*, 40*b* is illustrated as comprising a unitary structure, it should be appreciated that one or both of the end platforms 40*a*, 40*b* could in some embodiments be split similarly to the carriage 20 discussed previously. Thus, each end platform 40*a*, 40*b* may comprise multiple platforms, with one or more of such multiple platforms being adjustable and one or more of such multiple platforms being fixed.

As shown in the figures, each of the end platforms 40*a*, 40*b* may be adjustable with respect to the frame 15. More specifically, each of the end platforms 40*a*, 40*b* may be adapted to pivot with respect to the frame 15 between a level position, in which each of the end platforms 40*a*, 40*b* are parallel to the frame 15, and one or more raised positions, in which each of the end platforms 40*a*, 40*b* are angled or inclined with respect to the frame 15. Such a configuration allows for the end platforms 40*a*, 40*b* to function as handles or gripping points to allow for a wide range of exercise movements, particularly with end platforms 40*a*, 40*b* that may not have discrete handles 45, 48*a*, 48*b*, 49*a*, 49*b*.

In the figures, it can be seen that the first end platform 40*a* comprises an outer end 41*a* which faces away from the carriage 20 and an inner end 42*a* which faces towards the carriage 20. Similarly, the second end platform 40*b* comprises an outer end 41*b* which faces away from the carriage 20 and an inner end 42*b* which faces towards the carriage 20. The first end platform 40*a* includes an upper surface 44*a* and a lower surface 46*a*. The second end platform 40*b* similarly includes an upper surface 44*b* and a lower surface 46*b*.

In the embodiments shown in the figures, it can be seen that the first end platform 40*a* pivots about its inner end 42*a*, with its outer end 41*a* being raised or lowered when adjusting between positions. Similarly, the second end platform 40*b* is shown as pivoting about its inner end 42*b*, with its outer end 41*b* being raised or lowered when adjusting between positions. Thus, in the exemplary embodiment shown in the figures, the first end platform 40*a* is raised by pivoting in a clockwise direction and lowered by pivoting in a counterclockwise direction and the second end platform 40*b* is raised by pivoting in a counterclockwise direction and lowered by pivoting in a clockwise direction.

It should be appreciated, however, that the reverse configuration could be utilized. In such embodiments, the end platforms 40*a*, 40*b* may instead pivot about their outer ends 41*a*, 41*b*. Thus, in such embodiments, the first end platform 40*a* may be raised by pivoting a counterclockwise direction and lowered by pivoting in a clockwise direction and the second end platform 40*b* may be raised by pivoting in a clockwise direction and lowered by pivoting in a counterclockwise direction. In yet other embodiments, the end platforms 40*a*, 40*b* may instead pivot about various locations or points between their respective inner ends 42*a*, 42*b* and outer ends 41*a*, 41*b*.

With reference to FIGS. 1, 4, 6-8, and 12-15, it can be seen that each of the end platforms 40*a*, 40*b* may be adjustable between a first, level position and a second, raised position. The range of movement of each of the end platforms 40*a*, 40*b* may vary in different embodiments and should not be construed as limited by the exemplary figures. In some embodiments, the raised position may comprise a position in which the upper surfaces 44*a*, 44*b* of each end platform 40*a*, 40*b* are ninety degrees with respect to the upper surface 24 of the first platform 21 of the carriage 20. In other embodiments, each of the end platforms 40*a*, 40*b* may be adjustable to greater than ninety degrees with respect to the carriage 20 and frame 15.

In yet other embodiments, the raised position of each of the end platforms 40*a*, 40*b* may be various other angles with respect to the carriage 20 and frame 15. For example and without limitation, the raised position of each of the end platforms 40*a*, 40*b* may comprise the upper surfaces 44*a*, 44*b* of the end platforms 40*a*, 40*b* being 5, 10, 15, 20, 25, 30, 35, 40, 45, 50, 55, 60, 65, 70, 75, 80, 85, or 90 degrees with respect to the upper surface 22 of the first platform 21 of the carriage 20, or any angles therebetween.

Each of the end platforms 40*a*, 40*b* may be releasably locked in various raised positions. In some embodiments, the end platforms 40*a*, 40*b* may only be lockable in two positions: the level position and a single raised position. In other embodiments, the end platforms 40*a*, 40*b* may each be individually lockable between any number of positions, such as between the level position and multiple, discrete raised positions. By way of example and without limitation, in some embodiments, the end platforms 40*a*, 40*b* may each be lockable between a first, level position and multiple raised positions, such as raised positions at angular increments (e.g., the end platforms 40*a*, 40*b* could each be lockable in 15 degree increments).

The manner in which one or both of the end platforms 40*a*, 40*b* are adjustable between various positions may vary in different embodiments. Although not shown, the same bracket 30 structure including J-shaped slots 36*a*, 36*b* shown in connection with the carriage 20 may be used in the same manner to allow adjustment of one or both of the end platforms 40*a*, 40*b*. Similarly, the pivot connector 50*a*, 50*b* structure discussed below in connection with the end platforms 40*a*, 40*b* may be used in the same manner to allow adjustment of the one or more platforms 21, 23 of the carriage 20.

In the exemplary embodiment shown in the figures, it can be seen that the respective inner ends 42*a*, 42*b* of each of the end platforms 40*a*, 40*b* is pivotably connected to a bracket 58*a*, 58*b*, with the inner end 42*a* of the first end platform 40*a* being pivotably connected to a first bracket 58*a* and the inner end 42*b* of the second end platform 40*b* being pivotably connected to a second bracket 58*b*. In some embodiments, each end platform 40*a*, 40*b* may only be pivotably connected to a single bracket 58*a*, 58*b* rather than each end platform 40*a*, 40*b* being pivotably connected to a pair of brackets 58*a*, 58*b*.

A pivot connector 50*a*, 50*b* is connected between the frame 15 of the exercise machine 10 and each of the respective end platforms 40*a*, 40*b*. More specifically, as best shown in FIGS. 13 and 14, a first pivot connector 50*a* may be connected between the frame 15 of the exercise machine 10 and the first end platform 40*a*, and a second pivot connector 50*b* may be connected between the frame 15 of the exercise machine 10 and the second end platform 40*b*.

Each of the pivot connectors 50*a*, 50*b* comprises a first end 51*a*, 51*b* and a second end 52*a*, 52*b*. In the embodiment shown in the figures, the first end 51*a* of the first pivot connector 50*a* is pivotably connected to the frame 15 of the exercise machine 10 and the first end 51*b* of the second pivot connector 50*b* is pivotably connected to the frame 15 of the exercise machine 10. The second end 52*a* of the first pivot connector 50*a* is pivotably connected to the first end platform 40*a* and the second end 52*b* of the second pivot connector 50*b* is pivotably connected to the second end platform 40*b*.

Figure 13:
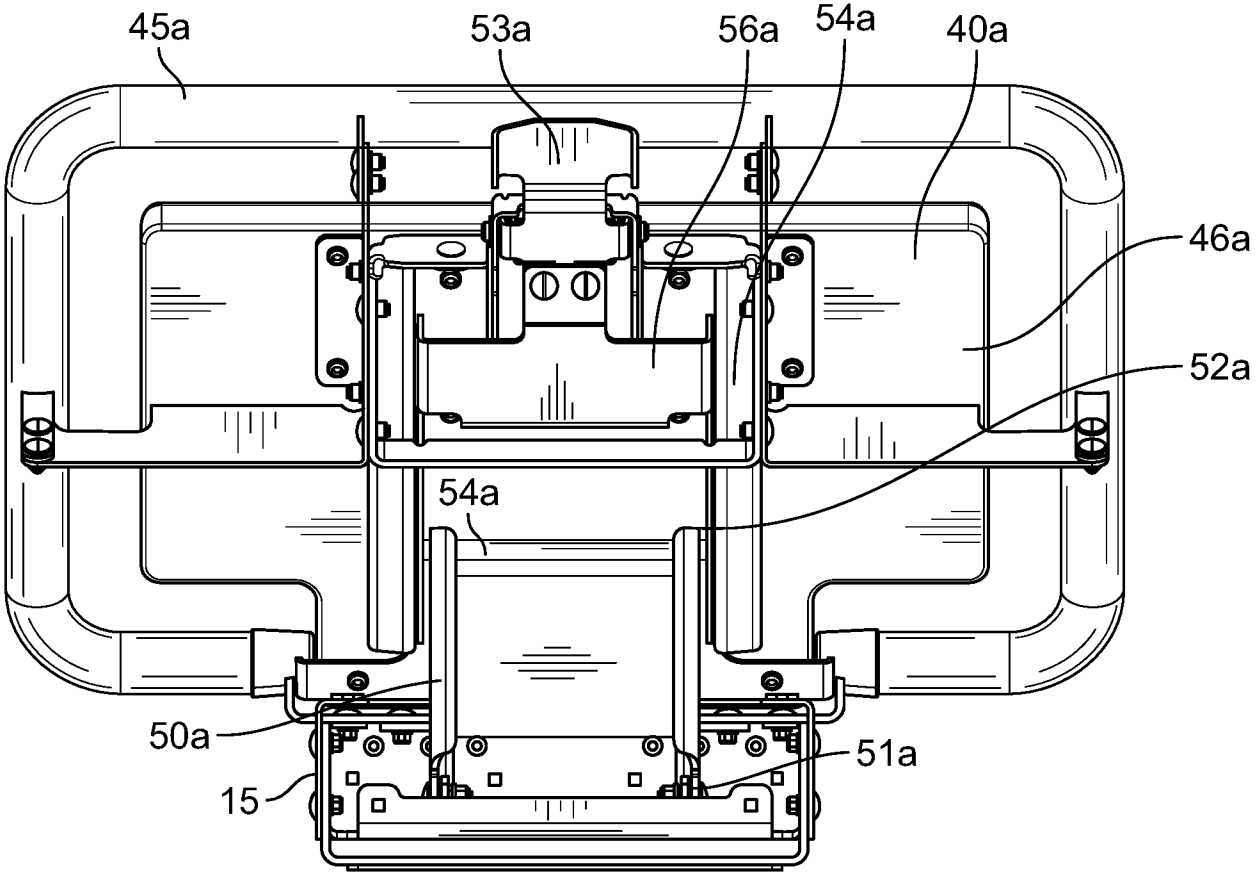
FIG. 13 is a first end view of a first end platform of an exercise machine with adjustable platforms in a raised position in accordance with an example embodiment.
Figure 14:
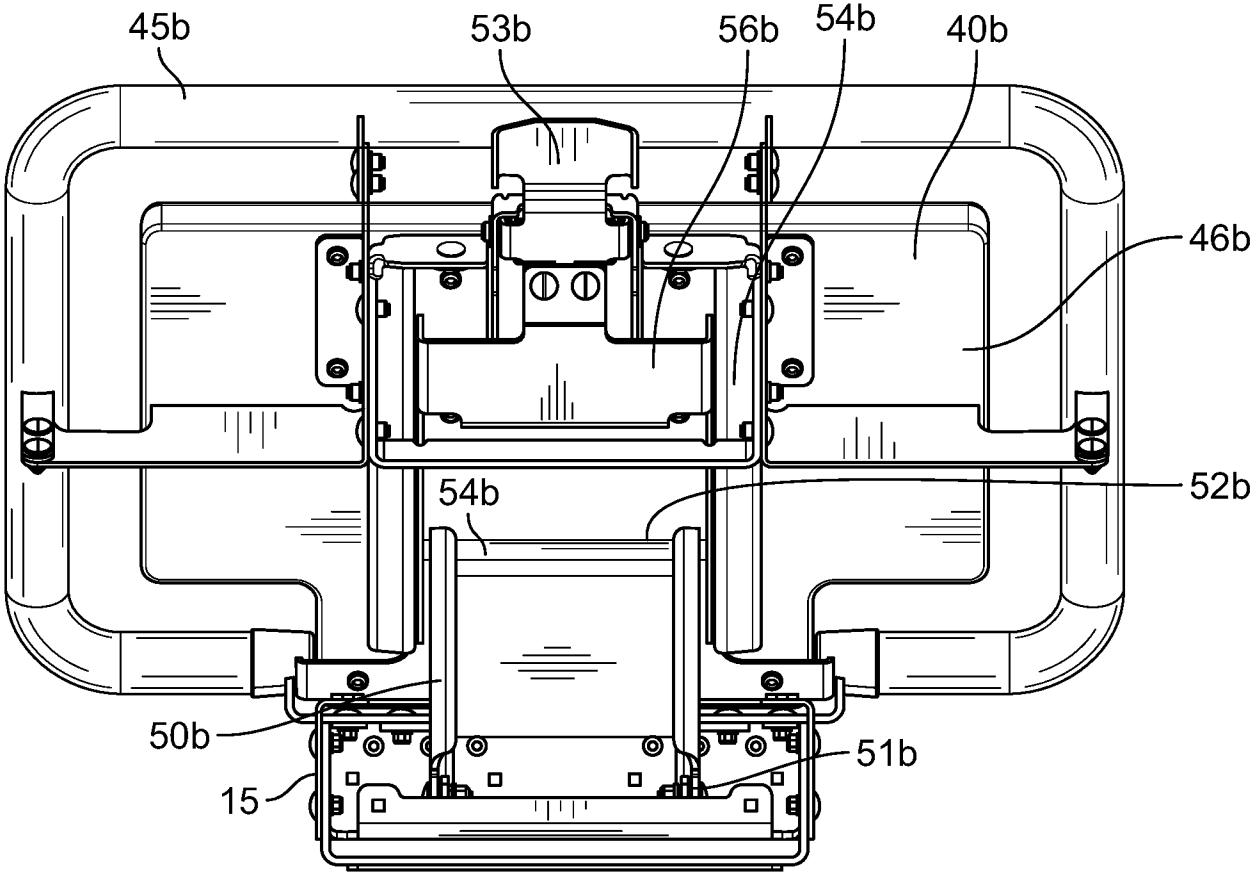
FIG. 14 is a second end view of a second end platform of an exercise machine with adjustable platforms in a raised position in accordance with an example embodiment.

As best shown in FIGS. 6, 13, and 14, each of the end platforms 40*a*, 40*b* may utilize a locking member 54*a*, 54*b* so as to be selectively locked in one of a plurality of raised positions. In the embodiment shown in the figures, a first locking member 54*a* is connected to the first end platform 40*a* and a second locking member 54*b* is connected to the second end platform 40*b*. Each of the locking members 54*a*, 54*b* may comprise an elongated, bracket-like member includes a plurality of slots 55*a*, 55*b*, with the first locking member 54*a* including a plurality of first slots 55*a* and the second locking member 54*b* including a plurality of second slots 55*b*.

The pivot connectors 50*a*, 50*b* may selectively and removably engage within one of the slots 55*a*, 55*b* of the locking members 54*a*, 54*b* is removably secure the end platform 40*a*, 40*b* in a desired raised position. More specifically, the first pivot connector 50*a* may engage within one of the slots 55*a* of the first locking member 54*a* to selectively and removably secure the first end platform 40*a* into one of a plurality of raised positions and the second pivot connector 50*b* may engage within one of the slots 55*b* of the second locking member 54*b* to selectively and removably secure the second end platform 40*b* into one of a plurality of raised positions.

The number of slots 55*a*, 55*b* in each of the locking members 54*a*, 54*b*, and thus the number of positions into which each of the end platforms 40*a*, 40*b* may be removably and selectively locked may vary in different embodiments. Thus, the number of slots 55*a*, 55*b* shown in the exemplary figures should not be construed as limiting. In some embodiments, only one or two slots 55*a*, 55*b* may be utilized. In other embodiments, three or more slots 55*a*, 55*b* may be utilized. While the figures illustrate that the first locking member 54*a* has the same number of slots 55*a* as the second locking member 54*b*, it should be appreciated that, in some embodiments, the first locking member 54*a* may have a different number of slots 55*a* than the second locking member 54*b*.

As best shown in FIGS. 13 and 14, each of the end platforms 40*a*, 40*b* may include a release member 53*a*, 53*b* which is utilized to release each of the end platforms 40*a*, 40*b* from a raised position. The first end platform 40*a* may include a first release member 53*a* and the second end platform 40*b* may include a second release member 53*b*. Each release member 53*a*, 53*b* may comprise a tab-like, handle structure which is connected, for example, to the underside of the end platforms 40*a*, 40*b*. The release members 53*a*, 53*b* may, in some embodiments, at least partially extend outwardly from the end platforms 40*a*, 40*b*.

Each of the release members 53*a*, 53*b* are adapted to be moved (e.g., by pressing on the release members 53*a*, 53*b*) to release the pivot connectors 50*a*, 50*b* from the locking members 54*a*, 54*b*. In the exemplary embodiment shown in the figures, the first release member 53*a* is adapted to move (e.g., by pushing or pivoting) a pivot member 56*a* which itself pushes the pivot connector 50*a* out of whichever of the slots 55*a* of the locking member 54*a* in which it is engaged. Similarly, the second release member 53*b* is adapted to move (e.g., by pushing or pivoting) a pivot member 56*b* which itself pushing the pivot connector 50*b* out of whichever of the slots 55*b* of the locking member 54*b* in which it is engaged.

Figure 15:
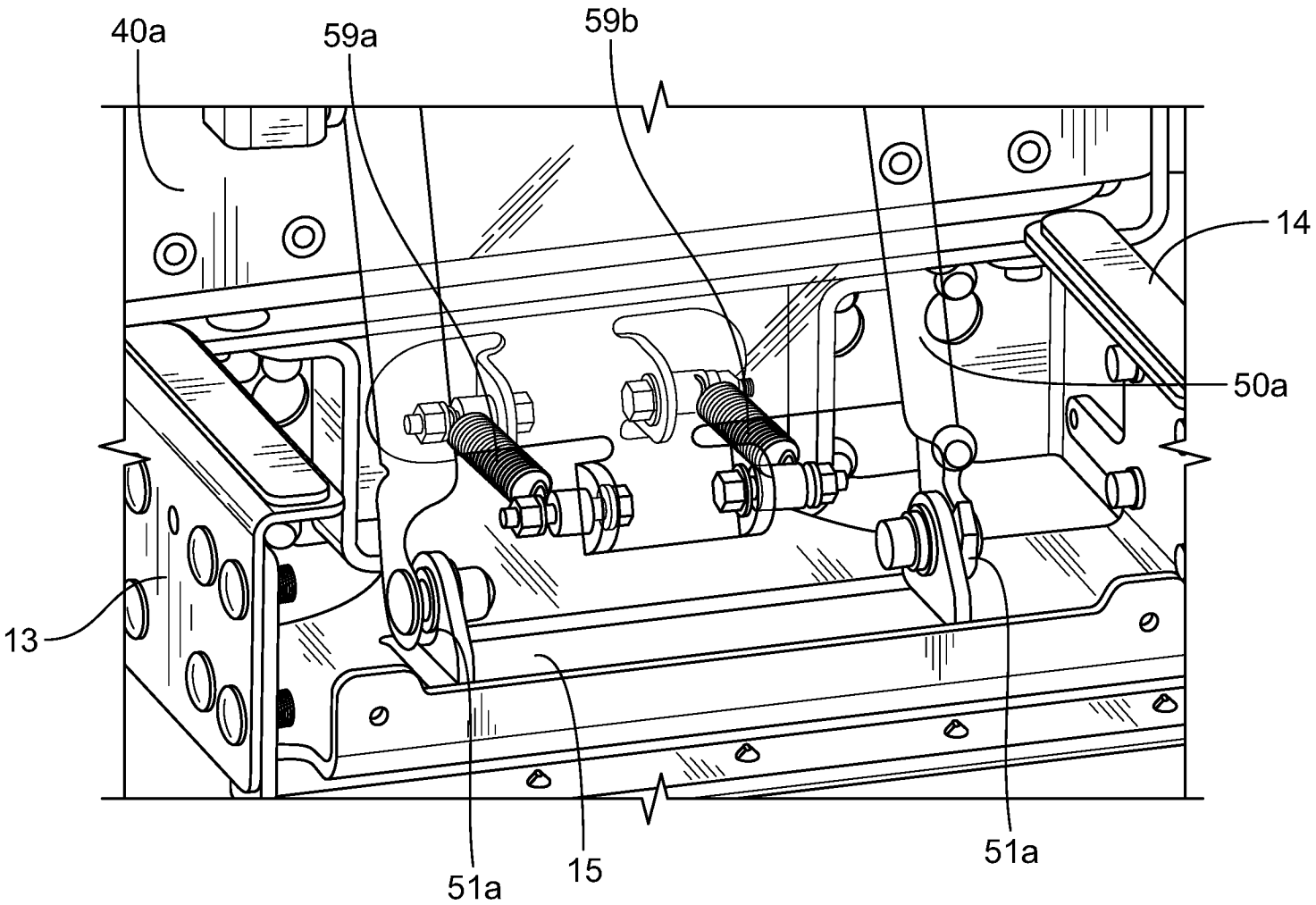
FIG. 15 is a perspective view of a pair of springs connected between a frame of an exercise machine and an end platform of an exercise machine with adjustable platforms in accordance with an example embodiment.

As shown in FIG. 15, one or more springs 59*a*, 59*b* may be connected between the end platforms 40*a*, 40*b* and the frame 15 of the exercise machine 10 to aid in smoothly raising or lowering the end platforms 40*a*, 40*b* with respect to the frame 15 of the exercise machine 10. In the illustrated embodiment, it can be seen that a first spring 59*a* and a second spring 59*b*, each comprised of coiled springs, may be connected between the frame 15 and the respective end platforms 40*a*, 40*b*. It should be appreciated that various other types of springs 59*a*, 59*b* may be utilized for this purpose. It should also be appreciated that the number of springs 59*a*, 59*b* utilized may vary in different embodiments.

Figure 17:
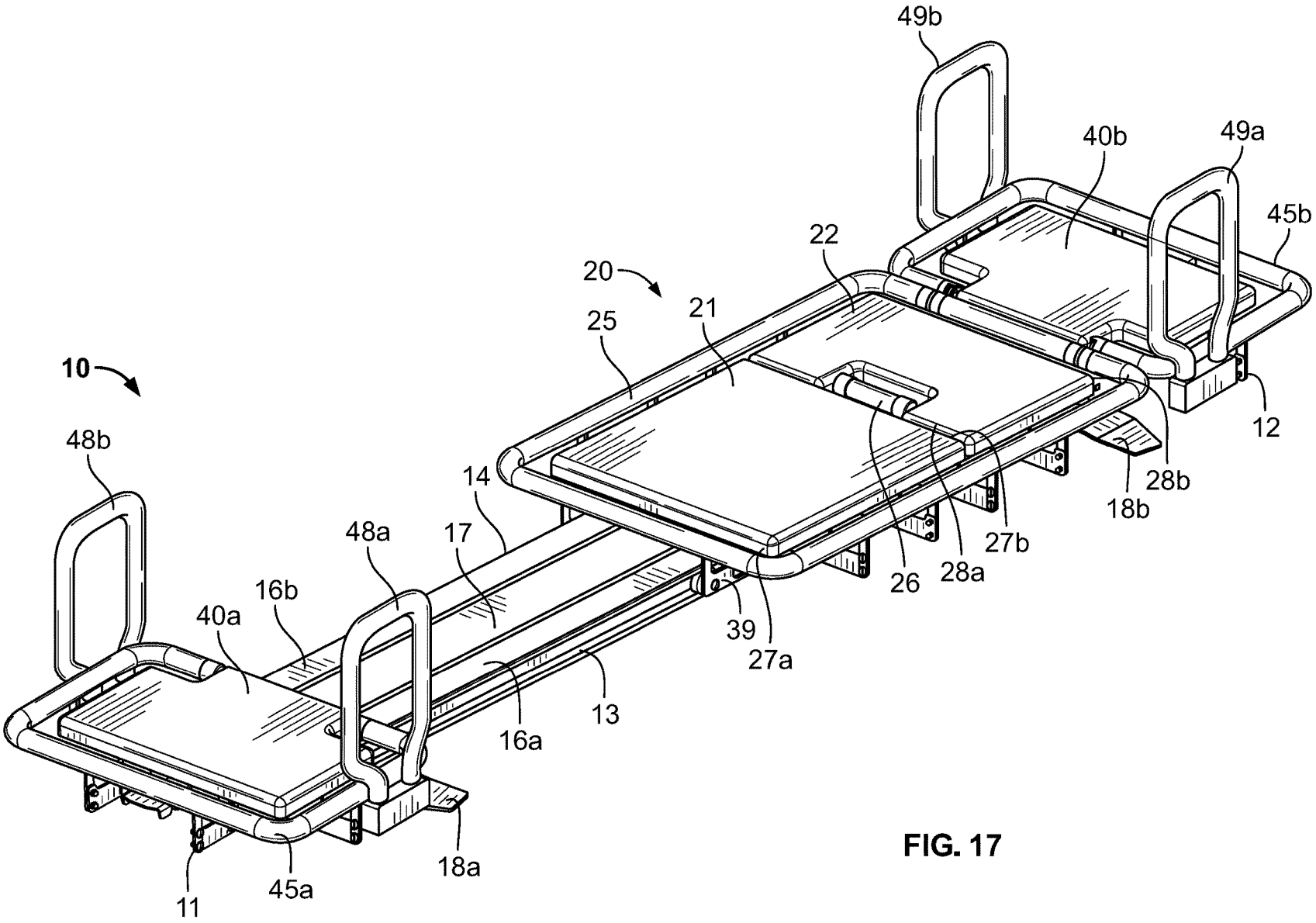
FIG. 17 is an upper perspective view of an exercise machine with adjustable platforms that includes end platform side handles in accordance with an example embodiment.

In some embodiments such as shown in FIG. 17, one or more of the end platforms 40*a*, 40*b* may each include one or more side handles 48*a*, 48*b*, 49*a*, 49*b*. In the exemplary embodiment shown in FIG. 17, the first end platform 40*a* is shown as including a pair of first side handles 48*a*, 48*b* and the second end platform 40*b* is shown as including a pair of second side handles 49*a*, 49*b*. Thus, the first end platform 40*a* includes a first side handle 48*a* on a first side and a second side handle 48*b* on a second side. Similarly, the second end platform 40*b* includes a first side handle 49*a* on a first side and a second side handle 49*b* on a second side. The side handles 48*a*, 48*b*, 49*a*, 49*b* may be fixedly or removably connected to the respective end platforms 40*a*, 40*b*. In some embodiments, the side handles 48*a*, 48*b*, 49*a*, 49*b* may be grasped when raising or lowering the end platforms 40*a*, 40*b* between various positions.

E. Operation of Preferred Embodiment

In use, the exercise machine 10 may be placed in position in various locations, such as in a home gym or exercise studio. Generally, an exerciser 70 will place one portion of their body on the carriage 20 and another portion of their body elsewhere (e.g., on the ground adjacent to the exercise machine 10, on the first end platform 40*a*, and/or on the second end platform 40*b*) and then move the carriage 20 in one or more directions. The exerciser 70 may, in some embodiments, select the amount of resistance force applied against the carriage 20 by adjusting the number of biasing members 60 connected between the carriage 20 and the frame 15.

When desired, the exerciser 70 may raise or lower one or more platforms 21, 23 of the carriage 20 to allow for a wider range of exercises to be performed. In the exemplary embodiment shown in the figures, the second platform 23 of the carriage 20 may be raised or lowered. The exerciser 70 may grasp any portion of the second platform 23 and pivot the second platform 23 upwardly to raise the second platform 23 into the raised position. As one example, the exerciser 70 may grasp one or more sides of the second platform 23 to raise or lower the second platform 23. As a further example, the exerciser 70 may grasp the central handle 26 of the second platform 23 to raise or lower the second platform 23.

When the second platform 23 is pivoted towards the raised position, the bracket 30 will slide over the pivot members 35 that are connected to the frame 39 of the carriage 20, and thus the bracket 30 will be raised with the second platform 23 such as shown in FIG. 16. The slots 36*a*, 36*b* of the bracket 30 will thus slid over the pivot members 35, though in some embodiments the converse arrangement may be utilized (e.g., the pivot members 35 slide within the slots 36*a*, 36*b* of the bracket 30). Upon reaching the distal end of the slots 36*a*, 36*b*, the pivot members 35 may lock into place (e.g., by locking into the distal end of the J-shaped slots 36*a*, 36*b* as shown in the figures).

While the figures illustrate an embodiment in which the second platform 23 is only lockable into a single raised position, it should be appreciated that, in some embodiments, the second platform 23 may be lockable into one of a plurality of raised positions. It should also be appreciated that the angular incline of the second platform 23 when in the raised position may vary in different embodiments, and thus should not be construed as limited to any of the exemplary angular inclines shown in the figures.

Figure 8:
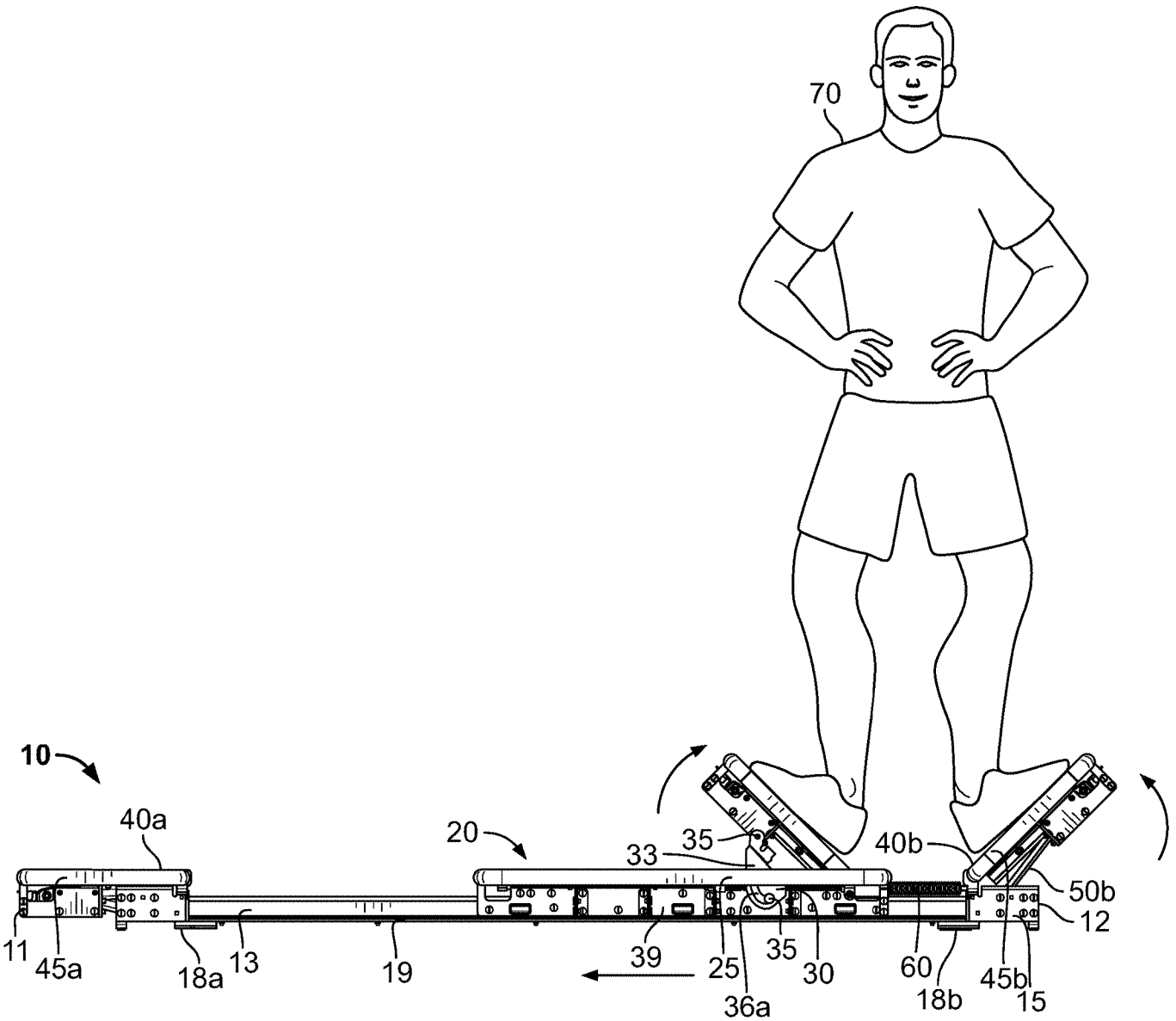
FIG. 8 is a side view of an exercise machine with adjustable platforms in use with an end platform and a carriage platform in a raised position in accordance with an example embodiment.
Figure 9:
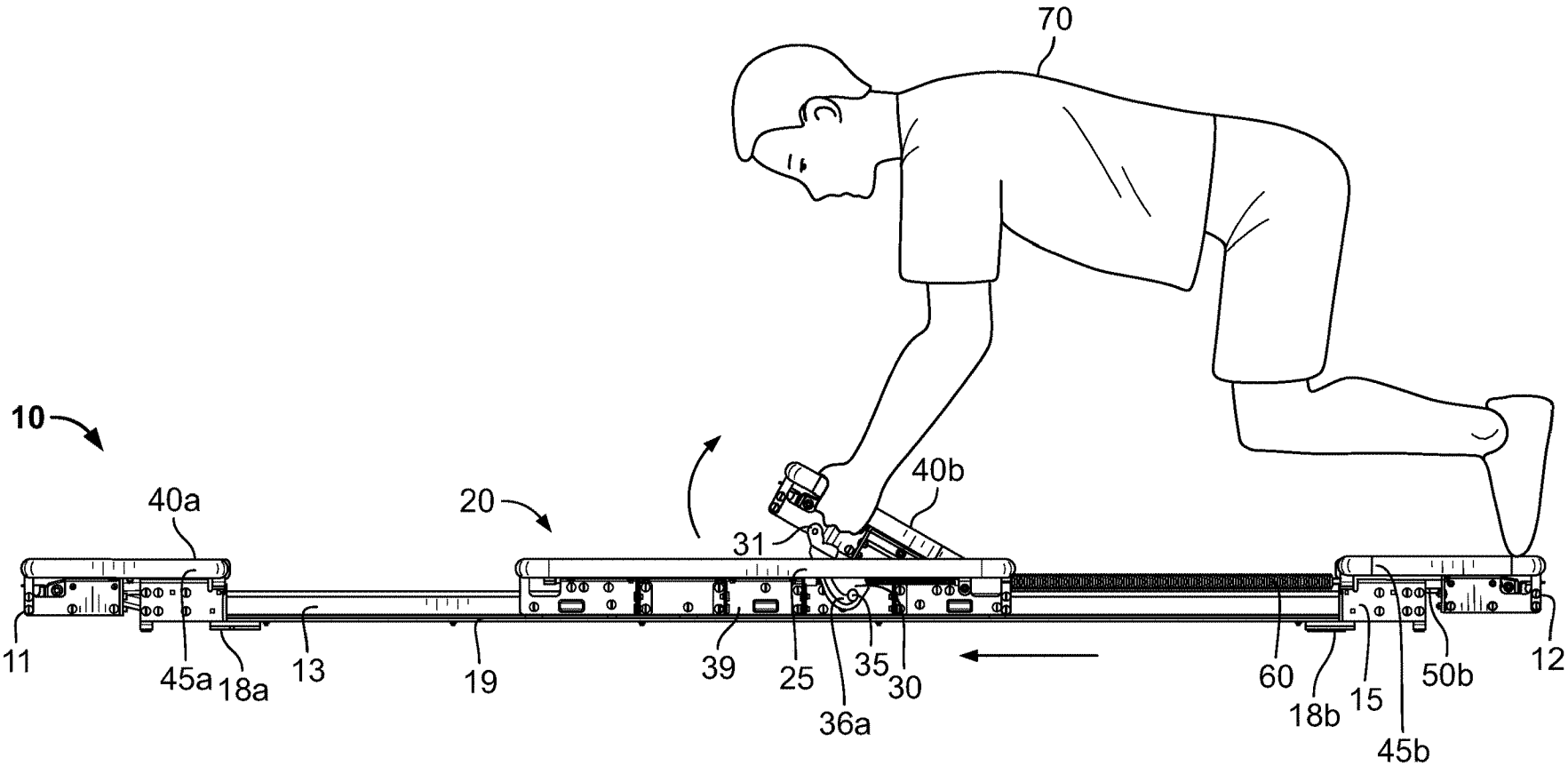
FIG. 9 is a side view of an exercise machine with adjustable platforms in use with a carriage platform in a raised position in accordance with an example embodiment.
Figure 10:
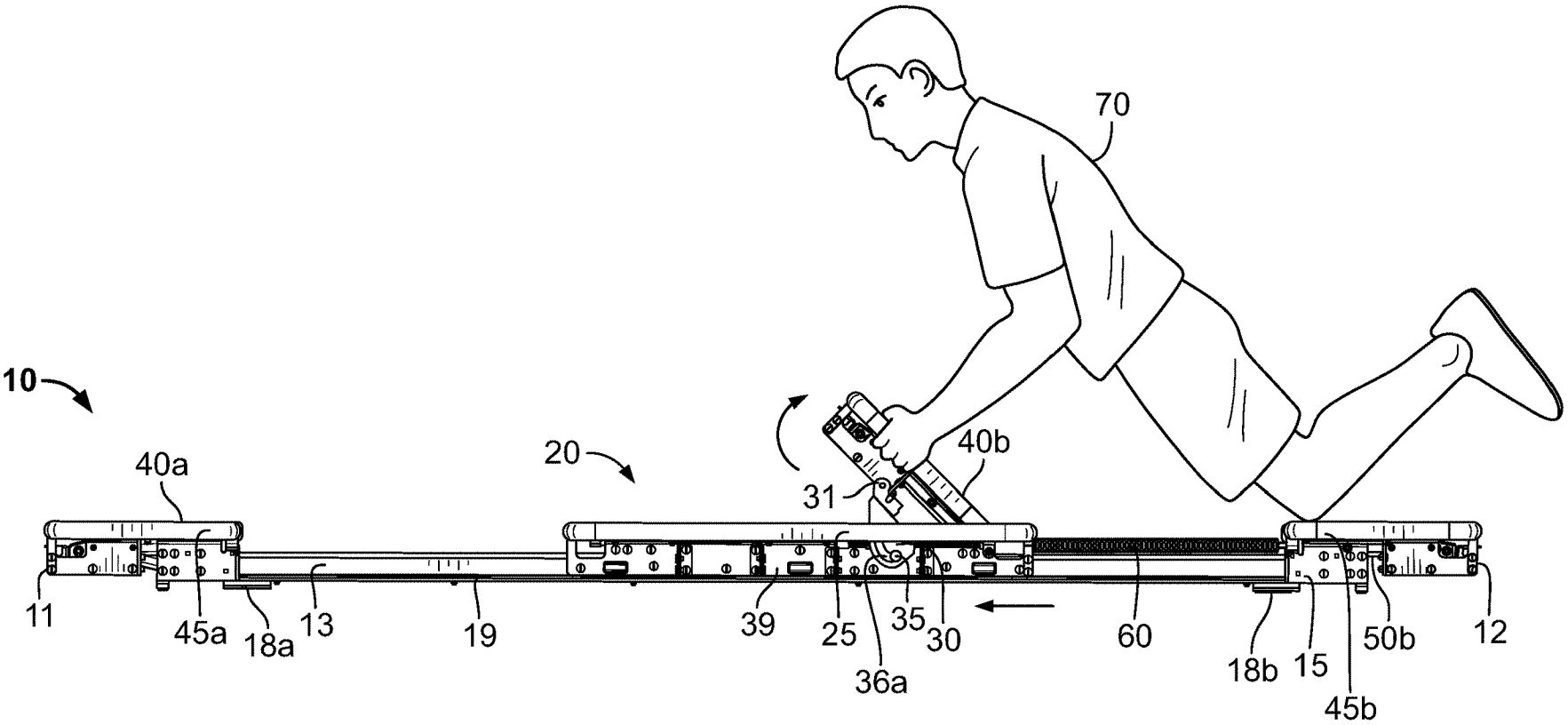
FIG. 10 is a side view of an exercise machine with adjustable platforms in use with a carriage platform in a raised position in accordance with an example embodiment.

With the second platform 23 in the raised position, the exerciser 70 may perform a wide range of exercise movements. FIG. 8 illustrates an embodiment in which the exerciser 70 places one foot on an inclined second platform 23 of the carriage 20 to perform an exercise. FIGS. 9 and 10 illustrate an embodiment in which the exerciser 70 grasps the second platform 23 of the carriage 20 with their hands to perform an exercise. It should be appreciated that the grasping point on the second platform 23 may vary in different embodiments and for different exercise movements. For example, the exerciser 70 may grasp the sides of the second platform 23, or may grasp the central handle 26.

When desired, the exerciser 70 may lower the second platform 23 into the level position, such as for storage or for performing additional exercise moves. The exerciser 70 will then grasp the second platform 23 and move the second platform 23 so as to disengage the pivot members 35 from the distal ends of the slots 36*a*, 36*b* of the bracket 30. Upon being released, freely slide along the slots 36*a*, 36*b* of the bracket 30 will freely slide over the pivot members 35 such that the second platform 23 may be lowered into the level position.

The exerciser 70 may also raise and/or lower the first and/or second end platforms 40*a*, 40*b* as desired to perform a wide range of exercise moves. In the embodiments shown in the figures, both of the end platforms 40*a*, 40*b* may be individually raised and lowered. However, in some embodiments, only one of the end platforms 40*a*, 40*b* may be raised and lowered, with the other end platform 40*a*, 40*b* remaining fixed.

To raise the first end platform 40*a*, an exerciser 70 will simply grasp any portion of the first end platform 40*a* and lift upwardly. For example, the exerciser 70 may grasp the outer end 41*a* of the first end platform 40*a* and lift upwardly. As a further example, the exercise 70 may grasp the perimeter handle 45*a* of the first end platform 40*a* and lift upwardly.

Similarly, to raise the second end platform 40*b*, an exerciser 70 will simply grasp any portion of the second end platform 40*b* and lift upwardly. For example, the exerciser 70 may grasp the outer end 41*b* of the second end platform 40*b* and lift upwardly. As a further example, the exerciser 70 may grasp the perimeter handle 45*b* of the second end platform 40*b* and lift upwardly.

With respect to both end platforms 40*a*, 40*b*, it should be appreciated that the manner in which the end platforms 40*a*, 40*b* are raised and locked into one of a plurality of raised positions will vary in different embodiments. In one example embodiments, each of the end platforms 40*a*, 40*b* will lock into each of the raised positions sequentially while being raised. Thus, the exerciser 70 will simply continue lifting the end platform 40*a*, 40*b* as it locks and releases from each of the raised positions until the desired raised position is reached. In other embodiments, the end platforms 40*a*, 40*b* may smoothly be raised through each of the raised positions without locking until the exerciser 70 stops lifting, at which point the end platforms 40*a*, 40*b* will lock into the nearest raised position as the point that the exerciser 70 stops applying upward, lifting force.

Once locked into the desired raised position, the exerciser 70 may perform various exercise moves by placing one or more body parts (e.g., limbs) on various portions of the raised end platforms 40*a*, 40*b*. FIG. 8 illustrates an embodiment in which an exerciser 70 has placed their foot on the raised end platform 40*b* while performing an exercise move. It should also be appreciated that the exerciser 70 may grasp various portions of the end platforms 40*a*, 40*b* while performing exercise movements. For example, an exerciser 70 may grasp the sides of one of the raised end platforms 40*a*, 40*b* to perform an exercise. As a further example, the exerciser 70 may grasp the perimeter handle 45*a*, 45*b* of one of the raised end platforms 40*a*, 40*b* to perform an exercise.

The manner in which the end platforms 40*a*, 40*b* are released so as to be lowered into a different raised position, or into the level position, may vary in different embodiments. In some embodiments, the exerciser 70 need only push down on the end platform 40*a*, 40*b* to lower the end platform 40*a*, 40*b*.

In the exemplary embodiment shown in the figures, the exerciser 70 will push on the release member 53*a*, 53*b* of the desired end platform 40*a*, 40*b*. The release member 53*a*, 53*b* which then push the pivot connector 50*a*, 50*b* so as to disengage the pivot connector 50*a*, 50*b* from the slot 55*a*, 55*b* in which it is locked, thereby allowing the end platform 40*a*, 40*b* to be freely pivotable into another raised position, or into the level position. The end platform 40*a*, 40*b* may sequentially lock into each of the raised positions it passes, or may smoothly be lowered into the level position depending upon the embodiment.

By using raised platforms 21, 23 of the carriage 20 and/or raised end platforms 40*a*, 40*b*, a wider variety of exercise moves may be performed than would be possible with conventional platforms 21, 23, 40*a*, 40*b* which are fixed at a level position. The incline provided by the raised platforms 21, 23, 40*a*, 40*b* may provide additional points which may be grasped or otherwise contacted by the exerciser 70 to perform a wide range of exercise moves. For example, raising the second platform 23 of the carriage 20 and the end platform 40*b* allows for the exerciser 70 to more easily straddle the carriage 20 and end platform 40*b* to perform a standing exercise as shown in FIG. 8 that would not otherwise be feasible if both platforms 23, 40*b* were level.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. An exercise machine, comprising:

a frame;

a carriage movably connected to the frame, wherein the carriage is adapted to be movable along a portion of the frame; and a first end platform pivotably connected to the frame, wherein the first end platform is adjustable between a level position with respect to the frame and a raised position with respect to the frame, and wherein the first end platform is adapted to be releasably locked in a plurality of positions;

wherein an upper surface of the first end platform is parallel with respect to an upper surface of the carriage when the first end platform is in the level position, and wherein the upper surface of the first end platform is not parallel with respect to the upper surface of the carriage when the first end platform is in the raised position.

2. The exercise machine of claim 1, wherein an outer end of the first end platform is raised with respect to an inner end of the first end platform when the first end platform is in the raised position.

3. The exercise machine of claim 1, wherein an angle of the upper surface of the first end platform is greater than zero degrees with respect to the upper surface of the carriage when the first end platform is in the raised position.

4. The exercise machine of claim 1, wherein an angle of the upper surface of the first end platform is ninety degrees with respect to the upper surface of the carriage when the first end platform is in the raised position.

5. The exercise machine of claim 1, wherein the first end platform is pivotably connected to the frame closer to an inner end of the first end platform than an outer end of the first end platform.

6. The exercise machine of claim 1, wherein the upper surface of the first end platform shares a common plane with the upper surface of the carriage when the first end platform is in the level position.

7. The exercise machine of claim 1, further comprising one or more handles connected to the first end platform.

8. The exercise machine of claim 1, further comprising a first handle connected to a first side of the first end platform and a second handle connected to a second side of the first end platform.

9. The exercise machine of claim 8, further comprising a third handle connected to an outer end of the first end platform.

10. The exercise machine of claim 9, wherein the first handle, the second handle, and the third handle are continuous.

11. The exercise machine of claim 1, further comprising a pivot connector connected between the frame and the first end platform, wherein a first end of the pivot connector is pivotably connected to the frame, and wherein a second end of the pivot connector is pivotably connected to the first end platform.

12. The exercise machine of claim 1, further comprising a locking member including a plurality of slots, wherein the locking member is adapted to releasably lock the first end platform in the plurality of positions.

13. The exercise machine of claim 12, further comprising a release member movably connected between the first end platform and the locking member, wherein the release member is adapted to release the first end platform from each of the plurality of positions.

14. The exercise machine of claim 1, further comprising:

a second end platform pivotably connected at or near a second end of the frame, wherein the second end platform is adjustable between a second level position with respect to the frame and a second raised position with respect to the frame;

wherein a second upper surface of the second end platform is parallel with respect to the upper surface of the carriage when the second end platform is in the second level position, and wherein the second upper surface of the second end platform is not parallel with respect to the upper surface of the carriage when the second end platform is in the second raised position.

15. A method of using the exercise machine of claim 1, comprising the steps of:

pivoting the first end platform from the level position to the raised position;

locking the first end platform in the raised position; and moving the carriage along the frame.

16. An exercise machine, comprising:

a frame;

a carriage movably connected to the frame, wherein the carriage is adapted to be movable along a portion of the frame;

a first end platform pivotably connected to the frame, wherein the first end platform is adjustable between a level position with respect to the frame and a raised position with respect to the frame;

wherein an upper surface of the first end platform is parallel with respect to an upper surface of the carriage when the first end platform is in the level position, and wherein the upper surface of the first end platform is not parallel with respect to the upper surface of the carriage when the first end platform is in the raised position;

a first handle connected to a first side of the first end platform;

a second handle connected to a second side of the first end platform; and a third handle connected to an outer end of the first end platform.

17. The exercise machine of claim 16, wherein the first handle, the second handle, and the third handle are continuous.

18. An exercise machine, comprising:

a frame;

a carriage movably connected to the frame, wherein the carriage is adapted to be movable along a portion of the frame;

a first end platform pivotably connected to the frame, wherein the first end platform is adjustable between a level position with respect to the frame and a raised position with respect to the frame;

wherein an upper surface of the first end platform is parallel with respect to an upper surface of the carriage when the first end platform is in the level position, and wherein the upper surface of the first end platform is not parallel with respect to the upper surface of the carriage when the first end platform is in the raised position; and a pivot connector connected between the frame and the first end platform, wherein a first end of the pivot connector is pivotably connected to the frame, and wherein a second end of the pivot connector is pivotably connected to the first end platform.

19. The exercise machine of claim 18, wherein an outer end of the first end platform is raised with respect to an inner end of the first end platform when the first end platform is in the raised position.

20. A method of using an exercise machine, wherein the exercise machine comprises a frame, a carriage movably connected to the frame, wherein the carriage is adapted to be movable along a portion of the frame, a first end platform pivotably connected to the frame, wherein the first end platform is adjustable between a level position with respect to the frame and a raised position with respect to the frame, wherein an upper surface of the first end platform is parallel with respect to an upper surface of the carriage when the first end platform is in the level position, and wherein the upper surface of the first end platform is not parallel with respect to the upper surface of the carriage when the first end platform is in the raised position, the method comprising:

pivoting the first end platform from the level position to the raised position;

locking the first end platform in the raised position; and moving the carriage along the frame.

* * * * *